US009097430B2

(12) United States Patent
Stanger

(10) Patent No.: US 9,097,430 B2
(45) Date of Patent: Aug. 4, 2015

(54) APPARATUS FOR TWO SIDED GRILLING IN AN OVEN

(75) Inventor: Keith A. Stanger, Trinity, FL (US)

(73) Assignee: ENODIS CORPORATION, Port Richey, FL (US)

( * ) Notice: Subject to any disclaimer, the term of this patent is extended or adjusted under 35 U.S.C. 154(b) by 257 days.

(21) Appl. No.: 13/560,856

(22) Filed: Jul. 27, 2012

(65) Prior Publication Data

US 2013/0025472 A1 Jan. 31, 2013

Related U.S. Application Data

(60) Provisional application No. 61/512,861, filed on Jul. 28, 2011.

(51) Int. Cl.

| | |
|---|---|
| ***A47J 39/00*** | (2006.01) |
| ***A47J 37/08*** | (2006.01) |
| ***F24C 15/16*** | (2006.01) |

(52) U.S. Cl.

CPC ..... *F24C 15/16* (2013.01)

(58) Field of Classification Search

CPC ..... F24C 15/16; A47J 39/00; A47J 36/22; A47J 43/18

USPC ..... 99/385, 389, 402, 403, 416, 422, 426, 99/448, 449, 450, 391

See application file for complete search history.

(56) References Cited

U.S. PATENT DOCUMENTS

| | | | | |
|---|---|---|---|---|
| 5,606,905 | A | 3/1997 | Boehm et al. | |
| 5,642,658 | A | 7/1997 | Liebermann | |
| 5,884,554 | A | 3/1999 | Sprick | |
| 6,038,965 | A | 3/2000 | Thorndyke | |
| 6,039,372 | A | 3/2000 | Noe et al. | |
| 7,841,270 | B2 | 11/2010 | Holbrook | |
| 2004/0031478 | A1 | 2/2004 | Gifford | |
| 2007/0240698 | A1 * | 10/2007 | Holbrook | 126/25 R |
| 2009/0272278 | A1 | 11/2009 | Von Herrmann et al. | |
| 2010/0270282 | A1 | 10/2010 | Fernandez et al. | |

OTHER PUBLICATIONS

International Preliminary Report on Patentability (IPRP) dated Oct. 11, 2013 from corresponding PCT/US2012/048696, pp. 7.

International Search Report and Written Opinion dated Oct. 16, 2012 from corresponding PCT/US2012/048696 (11 Pages).

* cited by examiner

*Primary Examiner* — Dana Ross
*Assistant Examiner* — Lindsey C Teaters
(74) *Attorney, Agent, or Firm* — Ohlandt, Greeley, Ruggiero & Perle, L.L.P.

(57) ABSTRACT

The grilling apparatus of the present disclosure has an upper cooking grid, a lower cooking grid, at least one pair of connectors movably connecting the upper cooking grid to the lower cooking grid, and a handle which is connected to the pair of connectors to allow the upper and lower cooking grids to move towards and away from one another. A food product is cooked between the upper and lower cooking grids, and each of the grids contacts a respective side of the food product.

11 Claims, 32 Drawing Sheets

Grid Rack - Oven Loading and Removal Process using Rack Tool

Step 1 - Load rack on runners between grids and push to back stop

Step 2 - Lift up on grid handle to close grids

Step 3 - End of cook cycle hook handle and press down to open grids

Step 2 - Lift up on grid handle to close grids

Step 4 - Hook and pull out rack

Step 5 - Engage tool and remove rack

Step 3 - End of cook cycle hook handle and press down to open grids

APPARATUS FOR TWO SIDED GRILLING IN AN OVEN

CROSS REFERENCE TO RELATED PATENT APPLICATIONS

This application claims the benefit of U.S. Provisional Application No. 61/512,861, filed Jul. 28, 2011. The contents of U.S. Provisional Application No. 61/512,861, filed Jul. 28, 2011, are hereby incorporated herein by reference in their entirety.

BACKGROUND

1. Field

The present disclosure generally relates to a device that produces a grilled product in a conventional oven. More particularly, the device includes upper and lower grids, wherein the food rack drops below the lower grids when in use, thereby allowing both surfaces of the food product to receive grill markings.

2. Discussion of the Background Art

Typically, an operator will place a food product on a grated surface in an oven to cook a first side and then manually flip the food product over to cook the second side. This process is very slow and requires additional operator intervention, as well as being potentially hazardous to the operator as they insert their arm into the oven to turn over the food product.

The present disclosure overcomes the aforementioned disadvantages and allows for faster cooking by grilling on both sides simultaneously. In addition, easy disassembly allows for easy cleaning without necessity of any tools.

The present disclosure also provides many additional advantages, which shall become apparent as described below.

SUMMARY

A grilling apparatus comprising: an upper cooking grid; a lower cooking grid; at least one pair of connectors movably connecting said upper cooking grid to said lower cooking grid; and a handle which is connected to said pair of connectors to allow said upper and lower cooking grids to move towards and away from one another.

Further objects, features and advantages of the present disclosure will be understood by reference to the following drawings and detailed description.

DETAILED DESCRIPTION OF THE PREFERRED EMBODIMENT

Grilling food on both sides at once speeds up the cooking process and provides desirable grill marking similar to an open char broiler. In this disclosure cooking grids are linked together to open and close by movement of a handle. A wire rack slides on guides between the grids and when closed the rack wires fall below the lower grid peaks to then deposit the food items in contact with both preheated grids. The entire cooking grid assembly is designed to slide in and out of an ovens side rack supports and will come apart without the use of tools for cleaning.

Figure 1:
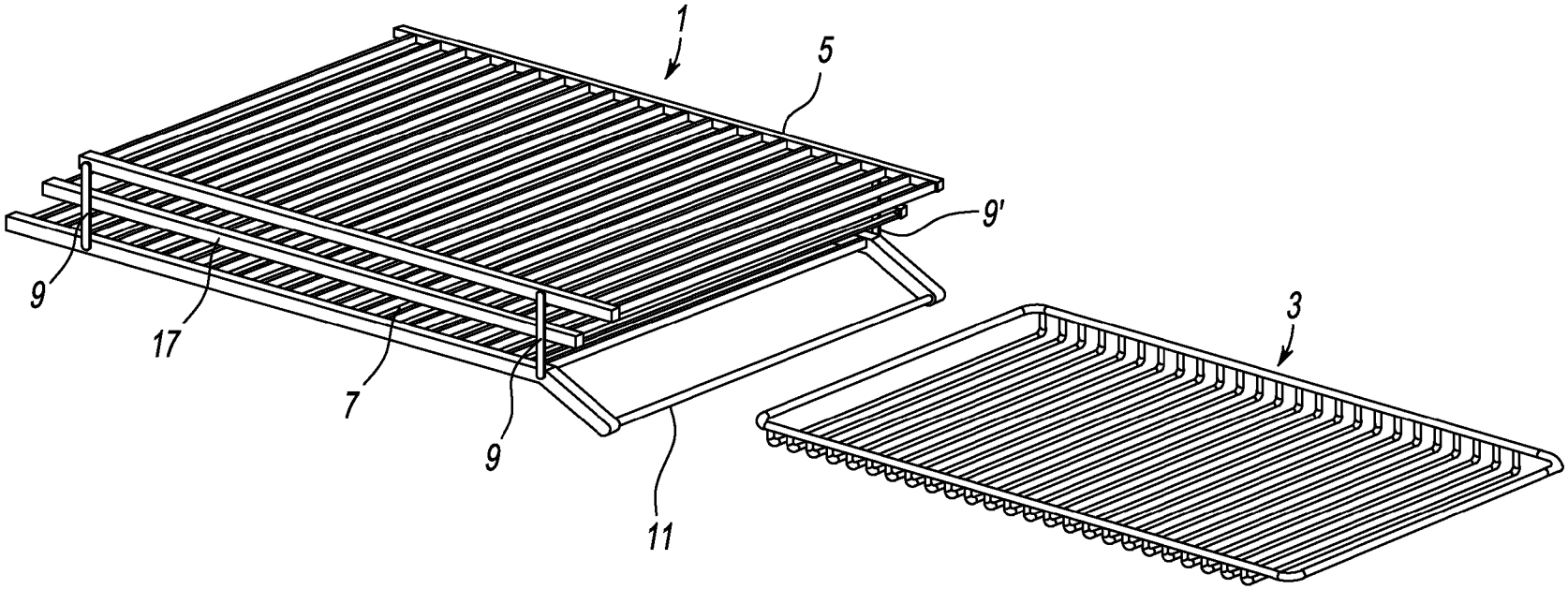
FIG. 1 is a front left side perspective view of the two sided grilling apparatus according to the present disclosure in the open position with the food rack removed therefrom.

The present disclosure can best be described by referring to the figures, wherein FIG. 1 is a front left side perspective view of the two sided grilling apparatus 1 according to the present disclosure in an open position with wire food rack 3 removed therefrom. Grilling apparatus 1 comprises upper grid 5 and lower grid 7 reciprocally adjoined by at least one pair of connectors 9,9' so as to allow said upper grid 5 and lower grid 7 to move towards (i.e. closed position) and away (i.e. open position) from one another. In addition, handle 11 is movably connected to lower grid 7 and connectors 9,9' to allow the user to open and/or close grilling apparatus 1.

Figure 2:
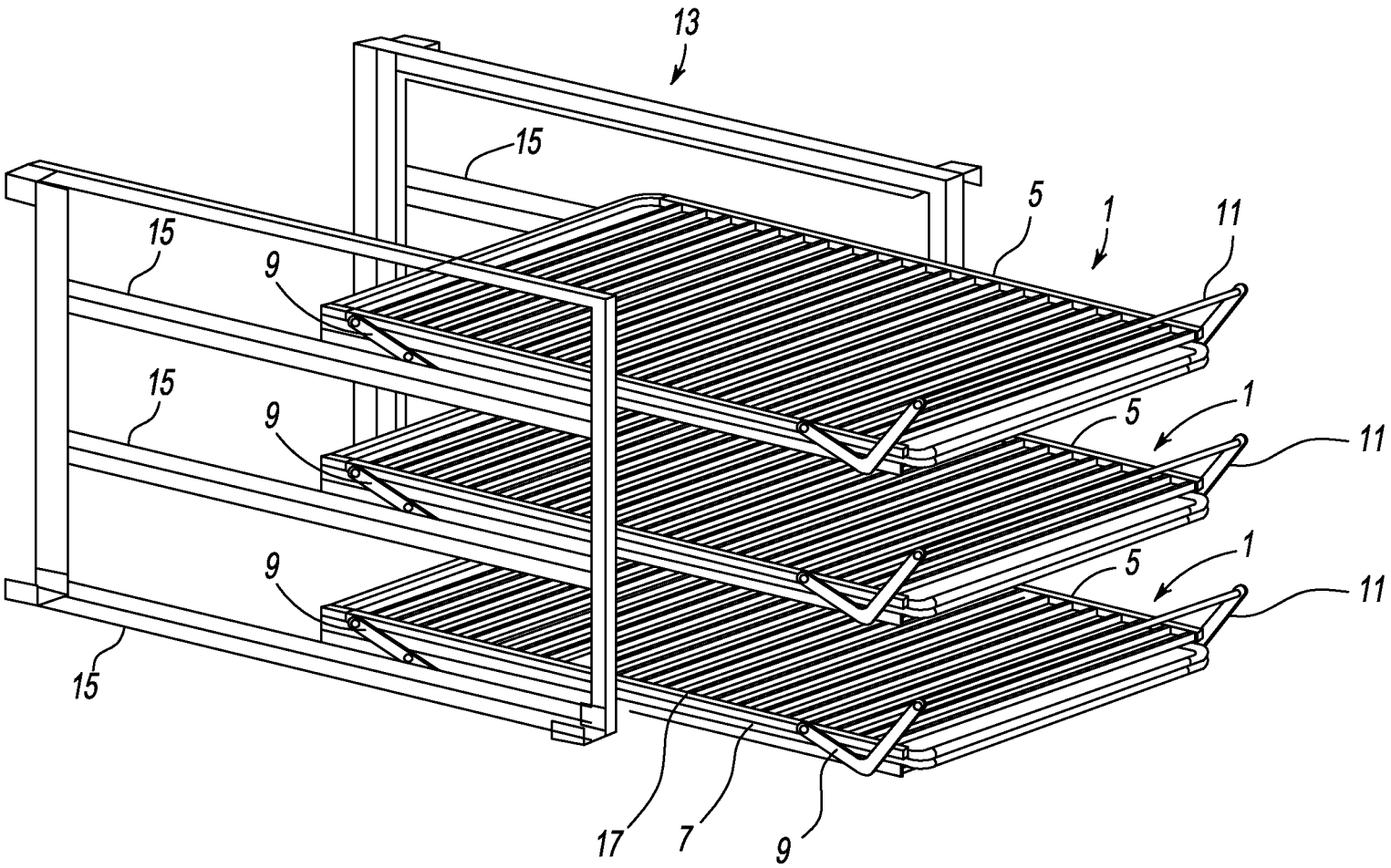
FIG. 2 is a front left side perspective view of a plurality of two sided grilling apparatuses being slid into an oven oven rack support assembly, wherein the grilling apparatuses are in the closed position with the food rack disposed between the upper and lower grids.

FIG. 2 depicts a plurality of two sided grilling apparatuses 1 being slidably mounted into oven rack support assembly 13, wherein assembly 13 comprises at least one rack supports 15. Each rack support 15 allows for a grilling apparatus 1 to be slidably mounted therein.

Figure 3:
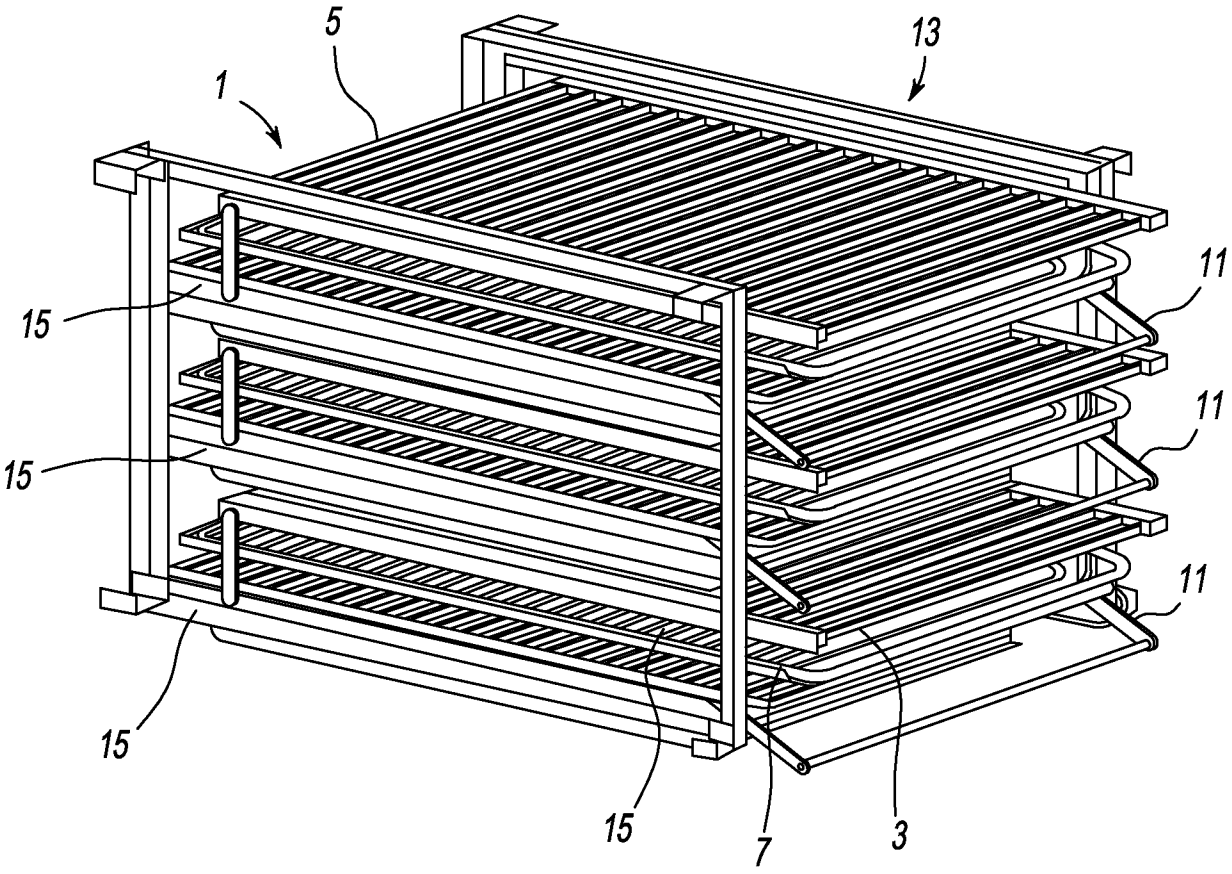
FIG. 3 is a front left side perspective view of the oven rack support assembly according to the present disclosure, wherein the two sided grilling apparatuses are in the open position.
Figure 4:
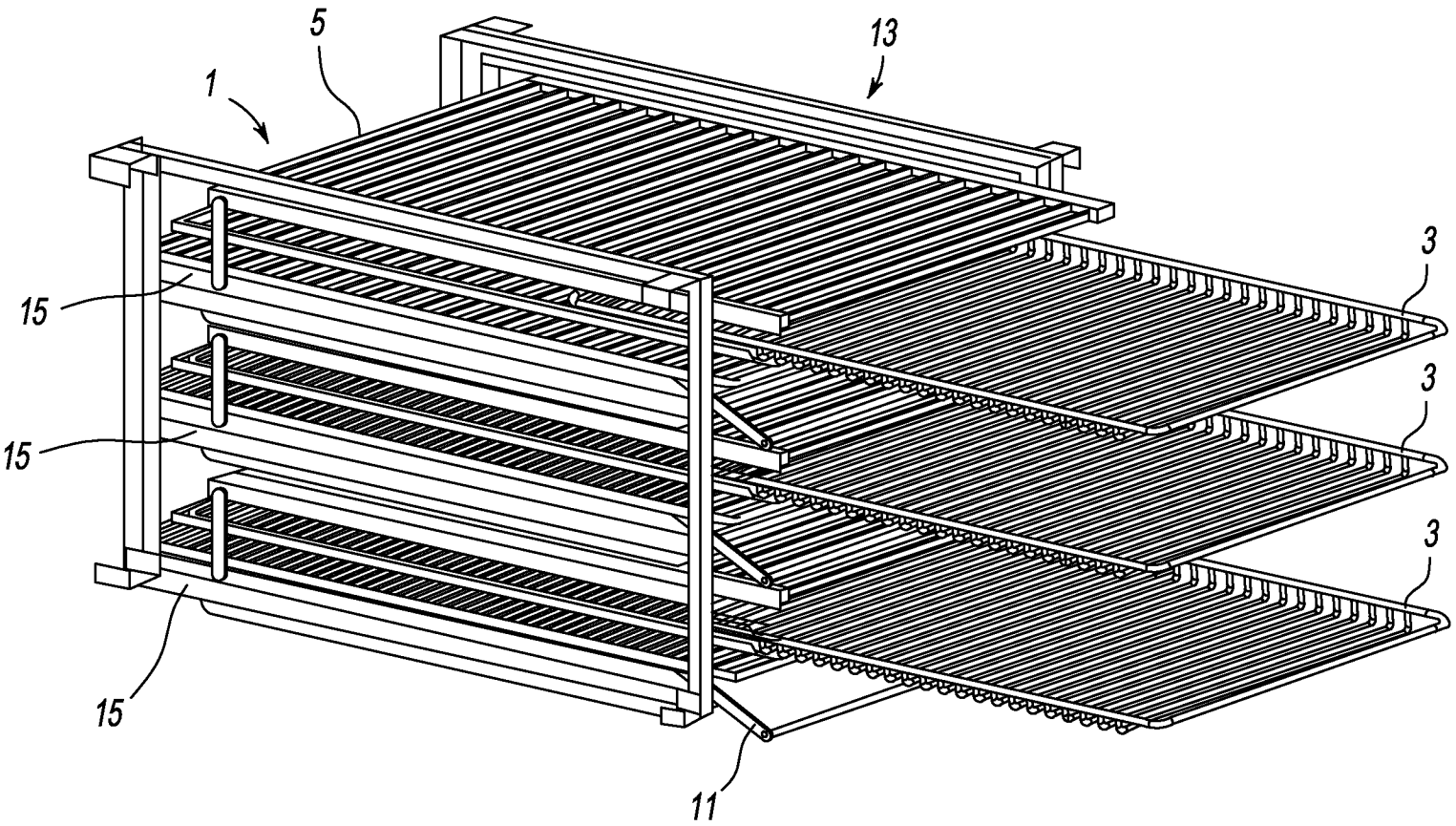
FIG. 4 is a front left side perspective view of the oven rack support assembly according the FIG. 3, wherein the food rack is being removed from each two sided grilling apparatuses while in the open position.

FIG. 3 is a front left side perspective view of the oven rack support assembly 13 according to the present disclosure, wherein the two sided grilling apparatuses 1 are in the open position, wherein a pair of sliding rails 17 move in a direction away from lower grid 7 lifting food rack 3 so that the wires of food rack 3 are above the grids of lower cooking grid 7 to allow for food rack 3 to be slidably removed from grilling apparatus 1, as shown in FIG. 4 below.

FIG. 4 is a front left side perspective view of the oven rack support assembly 13 according the FIG. 3, wherein the wire food racks 3 are being removed from each two sided grilling apparatuses 1 while in the open position.

Two sided grilling apparatus 1 may be made of metal materials. Upper grid 5 and lower grid 7 may be aluminum with polytetrafluoroethylene, marketed under the trade name Teflon, coating. This coating is hard anodized with Teflon additive in the chemistry to improve surface hardness and release properties, e.g., non-stick to prevent adhering of food items.

Figure 5A:
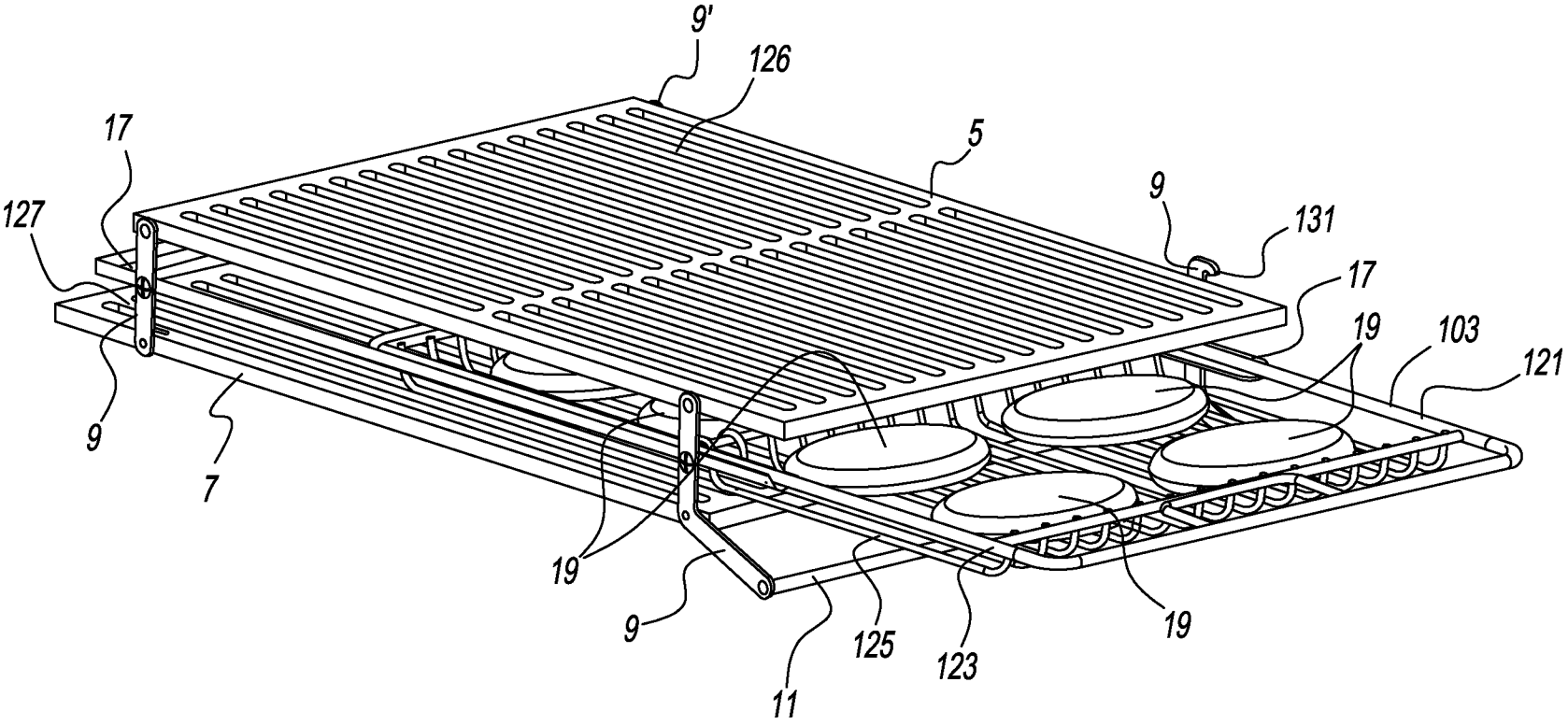
FIG. 5A is a front left side perspective view of another embodiment of the two sided grilling apparatus according to the present disclosure in the open position, wherein the food rack is being inserted in the two sided grilling apparatus.

FIG. 5A is a front left side perspective view of another embodiment of the two sided grilling apparatus according to the present disclosure generally referred to by reference numeral 100 in the open position. Two sided grilling apparatus 100 is the same as two sided grilling apparatus 1, however, the orientation of upper grids 126 and lower grids 127 are substantially parallel to sliding rails 17 rather than substantially perpendicular. Features that are the same in two sided grilling apparatus 100 and two sided grilling apparatus 1 will be identified by the same reference numerals.

Figure 5B:
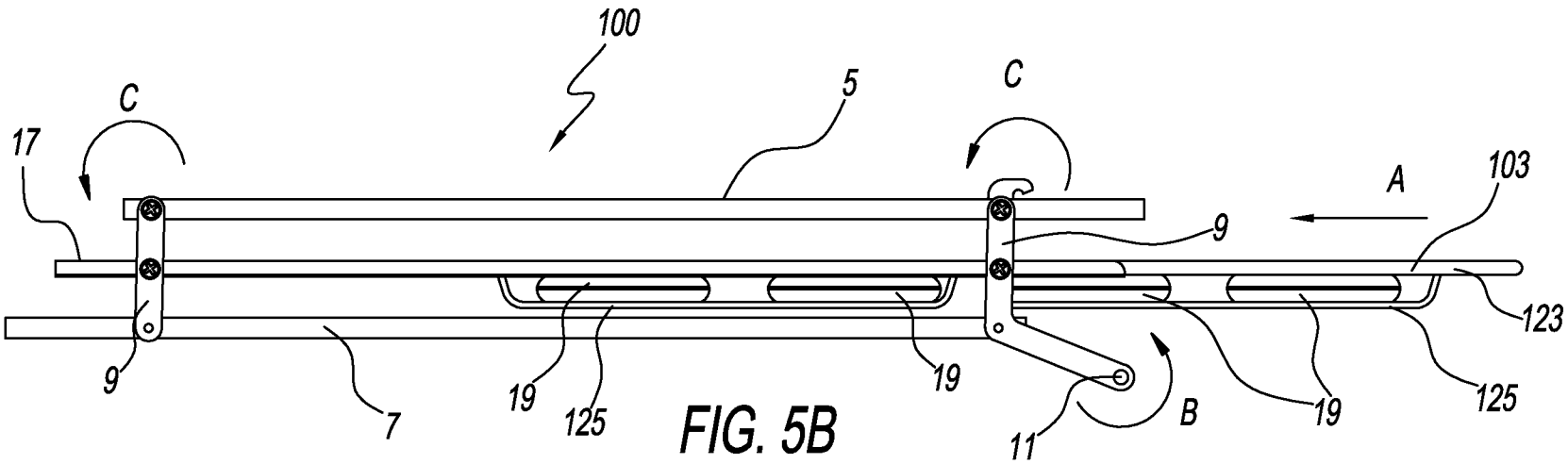
FIG. 5B is a left side view of the two sided grilling apparatus of FIG. 5A in the open position, wherein the food rack is being inserted in the two sided grilling apparatus.
Figure 5C:
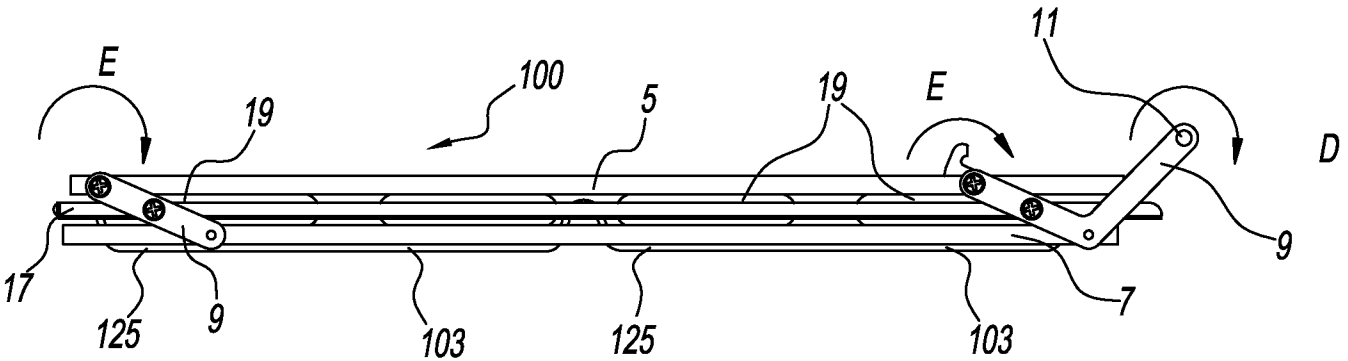
FIG. 5C is a left side view of the two sided grilling apparatus of FIG. 5A in the closed position with the food rack disposed between the upper and lower grids.

FIG. 5B is a left side view of two sided grilling apparatus 100 in the open position, wherein a food rack 103 is being inserted in two sided grilling apparatus 100. Food items 19 are supported on food rack 103. Food rack 103 has opposite side wires 121, 123, as shown in FIG. 5A, that are each threaded into one of sliding rails 17. Sliding rails 17 may each have a "L" shaped cross-section so that side wires 121, 123 of food rack 103 may fit above a portion of rails 17. Food rack 103 is moved in a direction A to an inserted position between upper grid 5 and lower grid 7 and above lower grid 7 so that support wires 125 are each aligned between two adjacent lower grids 127 of lower grid 7. When food rack 103 is in the inserted position, handle 11 may be rotated as shown by arrow B to rotate connectors 9,9', as shown by arrows C, from the open position to the closed position, as shown in FIG. 5C. When handle 11 is rotated as shown by arrow B to rotate connectors 9,9', as shown by arrows C, rails 17 move toward lower grid 7.

FIG. 5C is a left side view of two sided grilling apparatus 100 in the closed position with food rack 103 disposed between upper grid 5 and lower grid 7. Support wires 125 are spaced apart such that when food rack 103 is disposed between upper grid 5 and lower grid 7 in the closed position support wires 125 fall below lower grids 127 of lower grid 7, thereby allowing food items 19 disposed on food rack 103 to be in contact with both upper grid 5 and lower grid 7. Two sided grilling apparatus 100 is maintained in the closed position by gravity. Handle 11 is rotated, as shown by arrow D, to rotate connectors 9,9', as shown by arrows E, from the closed position to the open position, as shown in FIG. 5B. When handle 11 is rotated as shown by arrow D to rotate connectors 9,9', as shown by arrows E, rails 17 move away from lower grid 7 so that support wires 125 are above lower grids 127 of lower grid 7.

Figure 5D:
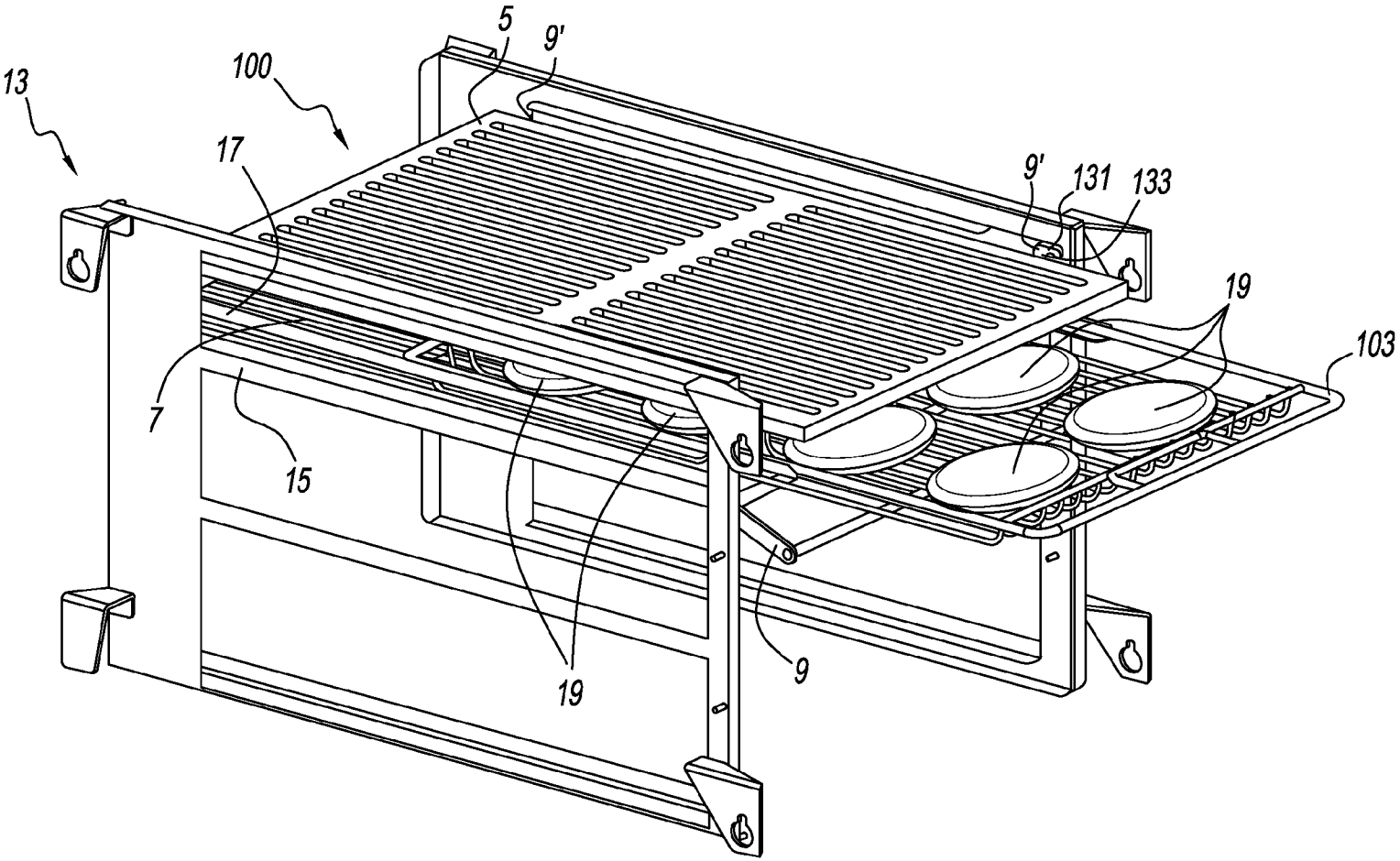
FIG. 5D is a front left side perspective view of the two sided grilling apparatus of FIG. 5A, wherein the two sided grilling apparatus is in the open position on the oven rack support assembly.
Figure 6:
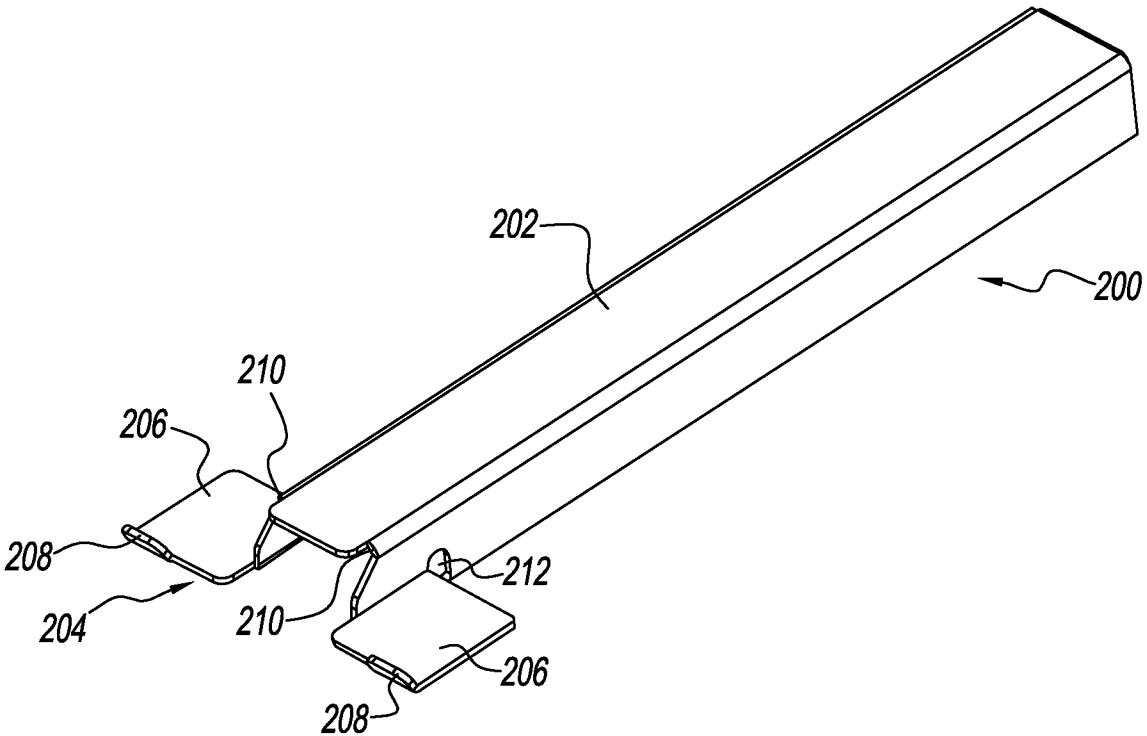
FIG. 6 is a front right side perspective view of a rack tool of the present disclosure.
Figure 7:
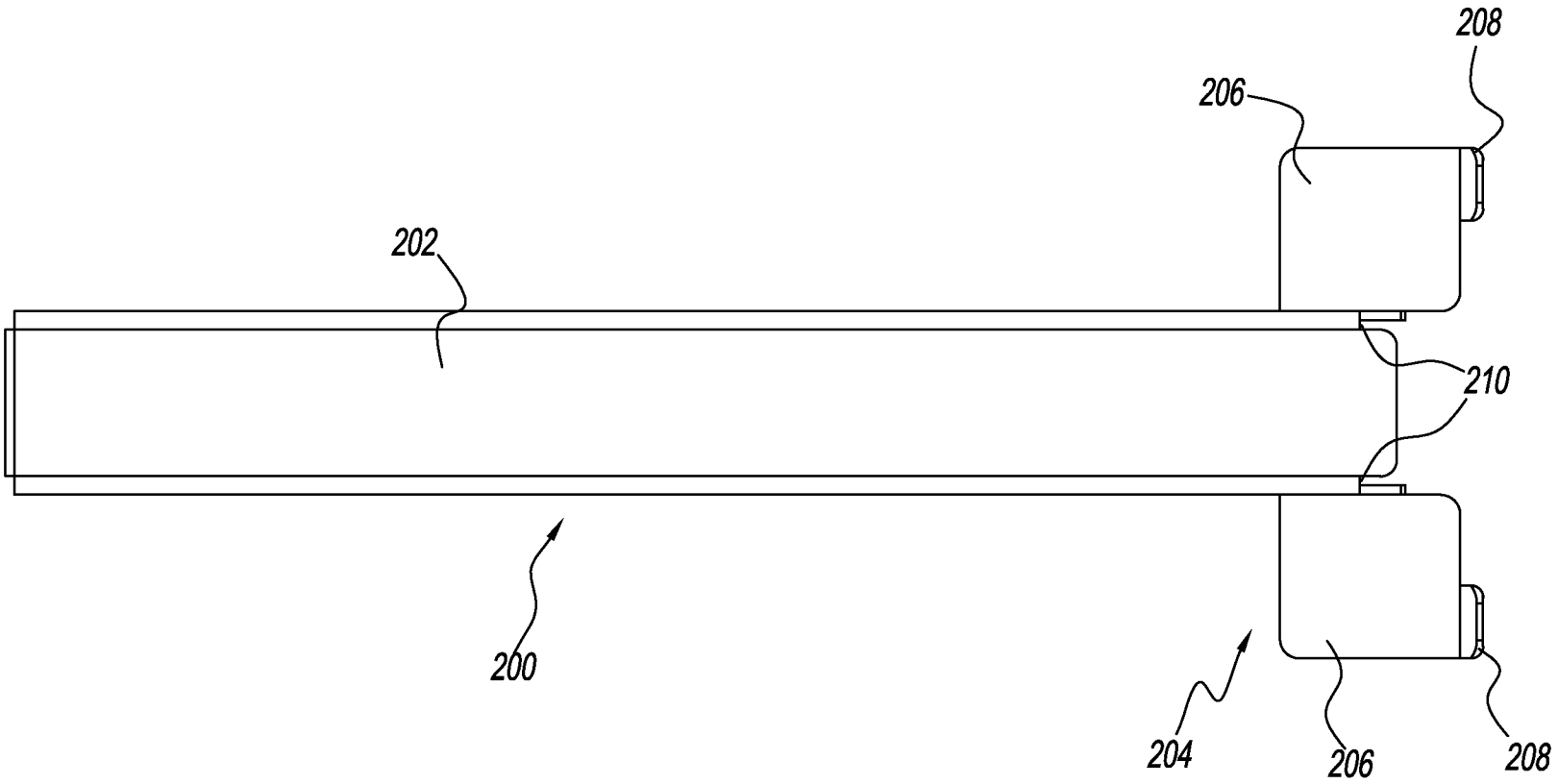
FIG. 7 is a top view of the rack tool of FIG. 6.
Figure 8:
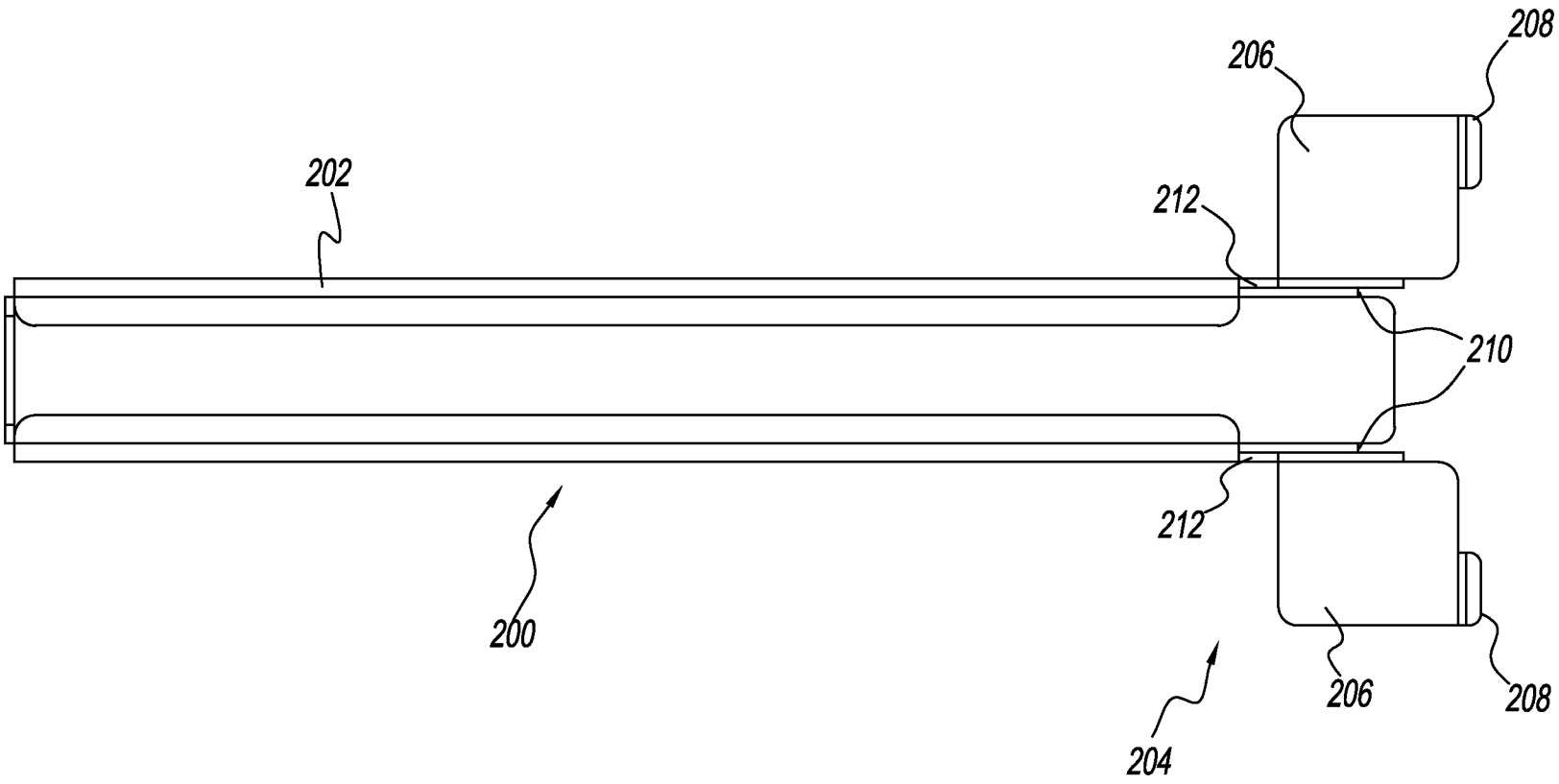
FIG. 8 is a bottom view of the rack tool of FIG. 6.
Figure 9:
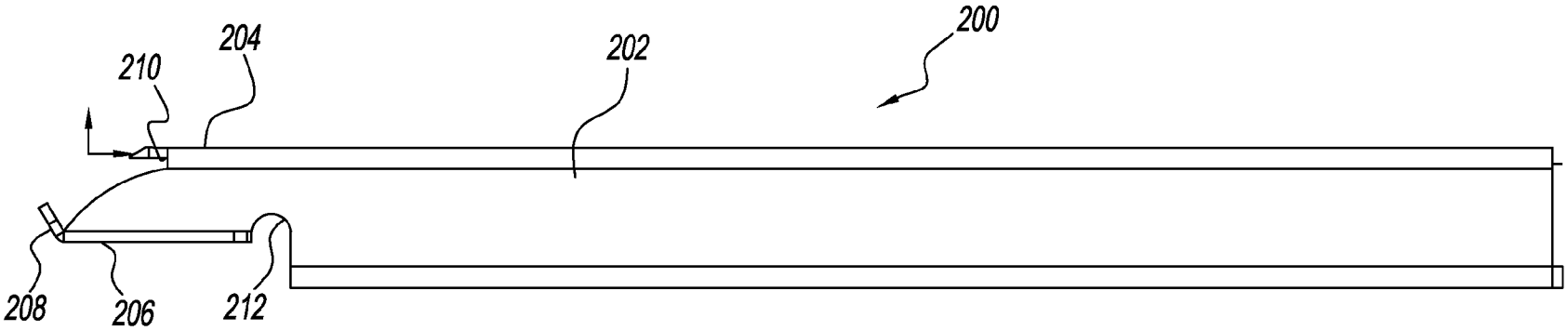
FIG. 9 is a right side view of the rack tool of FIG. 6.

FIG. 5D is a front left side perspective view of two sided grilling apparatus 100 in the open position on oven rack support assembly 13. Two sided grilling apparatus 100 is maintained in the open position by a hook portion 131 on one of connectors 9,9' and a peg 133 protruding from assembly 13. As handle 11 is rotated to rotate connectors 9,9' from the closed position to the open position, hook portion 131 abuts against peg 133 when two sided grilling apparatus 100 reaches the open position preventing connectors 9, 9' and handle 11 from further movement in the direction shown by arrow D in FIG. 5C this is to maintain two sided grilling apparatus 100 in the open position to accept food rack 103. Alternatively, a peg may protrude from upper grid 5.

Referring to FIGS. 6-9, a rack tool 200 is connectable to food rack 103. Rack tool 200 has a handle portion 202 that may be grasped by the hand of a user and a rack connection portion 204 that is connectable to food rack 103. Rack connection portion 204 has two side flanges 206 on opposite sides of rack tool 200 each with a hook member 208. Rack connection portion 204 also has connection grooves 210 formed on opposite top and side portions of rack tool 200 and connection apertures 212 formed on opposite bottom and side portions of rack tool 200.

Figure 10:
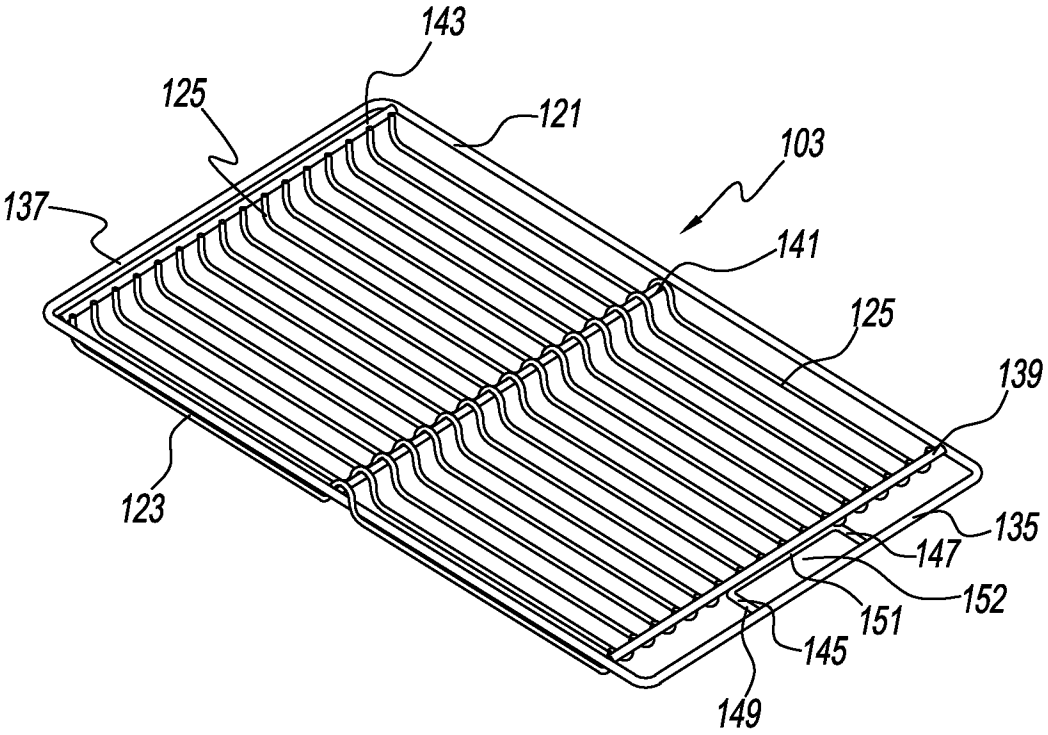
FIG. 10 is a front left side perspective view of a food rack.

FIG. 10 is a front left side perspective view of food rack 103 that may be used with two sided grilling apparatus 100. However, other food racks may be used with two sided grilling apparatus 100 having connection wires that are spaced apart such that when food rack is disposed between upper grid 5 and lower grid 7 in the closed position the connection wires fall below lower grids 127 of lower grid 7. Food rack 103 has a front wire 135 between, and continuous with, side wires 121, 123 and a rear wire 137 between, and continuous with, side wires 121, 123 on an opposite side thereof. Front intermediate wire 139, middle intermediate wire 141, and rear intermediate wire 143 are connected between side wires 121, 123. Support wires 125 are connected on opposite sides to front intermediate wire 139 and rear intermediate wire 143 and are curved to pass over a middle intermediate wire 141. A connector wire 145 is connected to front wire 135 and front intermediate wire 139. Connector wire 145 is shaped to mate with rack tool 200. Connector wire 145 has side members 147, 149 and middle member 151 forming a "U" shape forming a space 152 with front wire 135.

Figure 11:
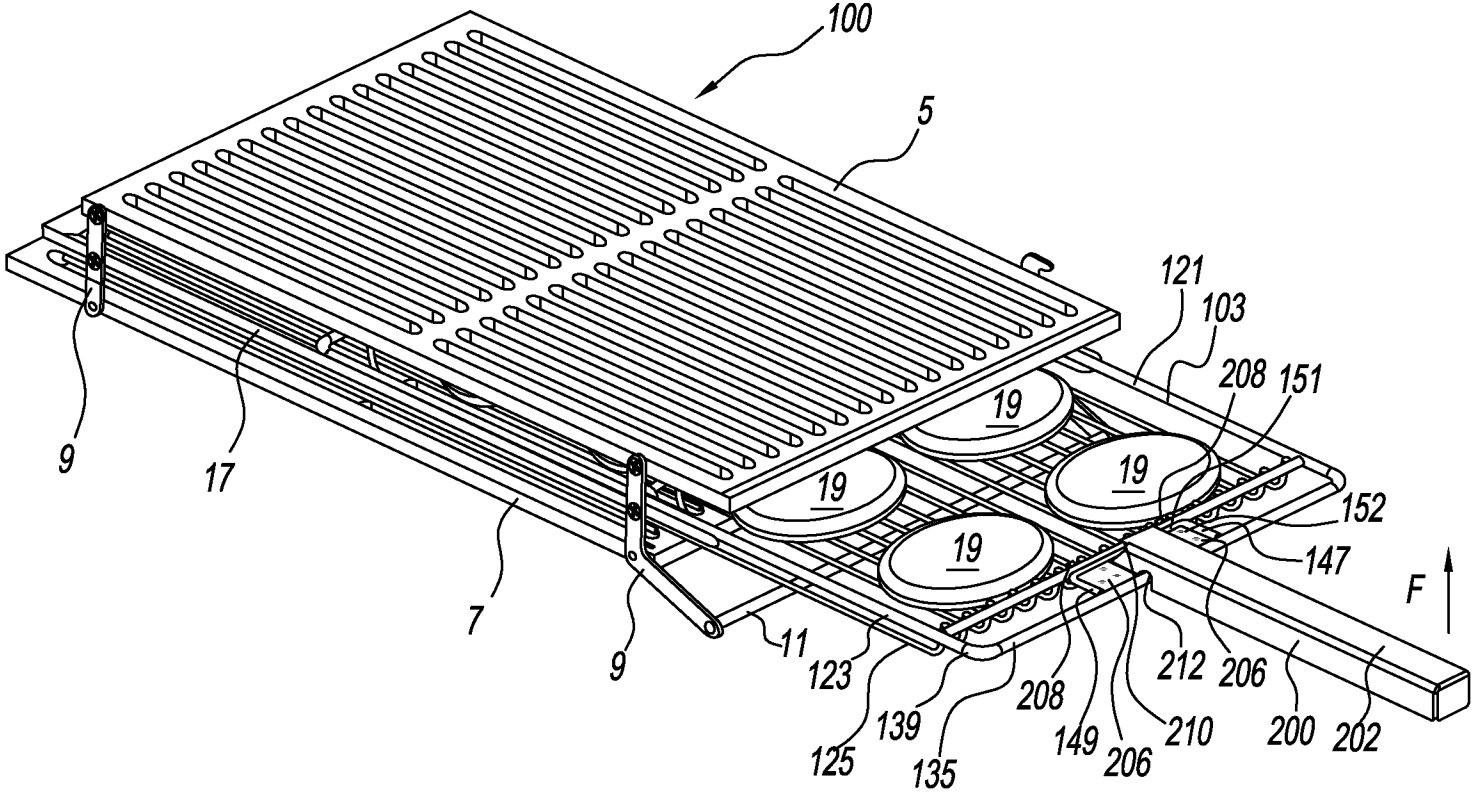
FIG. 11 is a front left side perspective view of the two sided grilling apparatus of FIG. 5A in the open position with the food rack connected to the rack tool and being removed therefrom.
Figure 12:
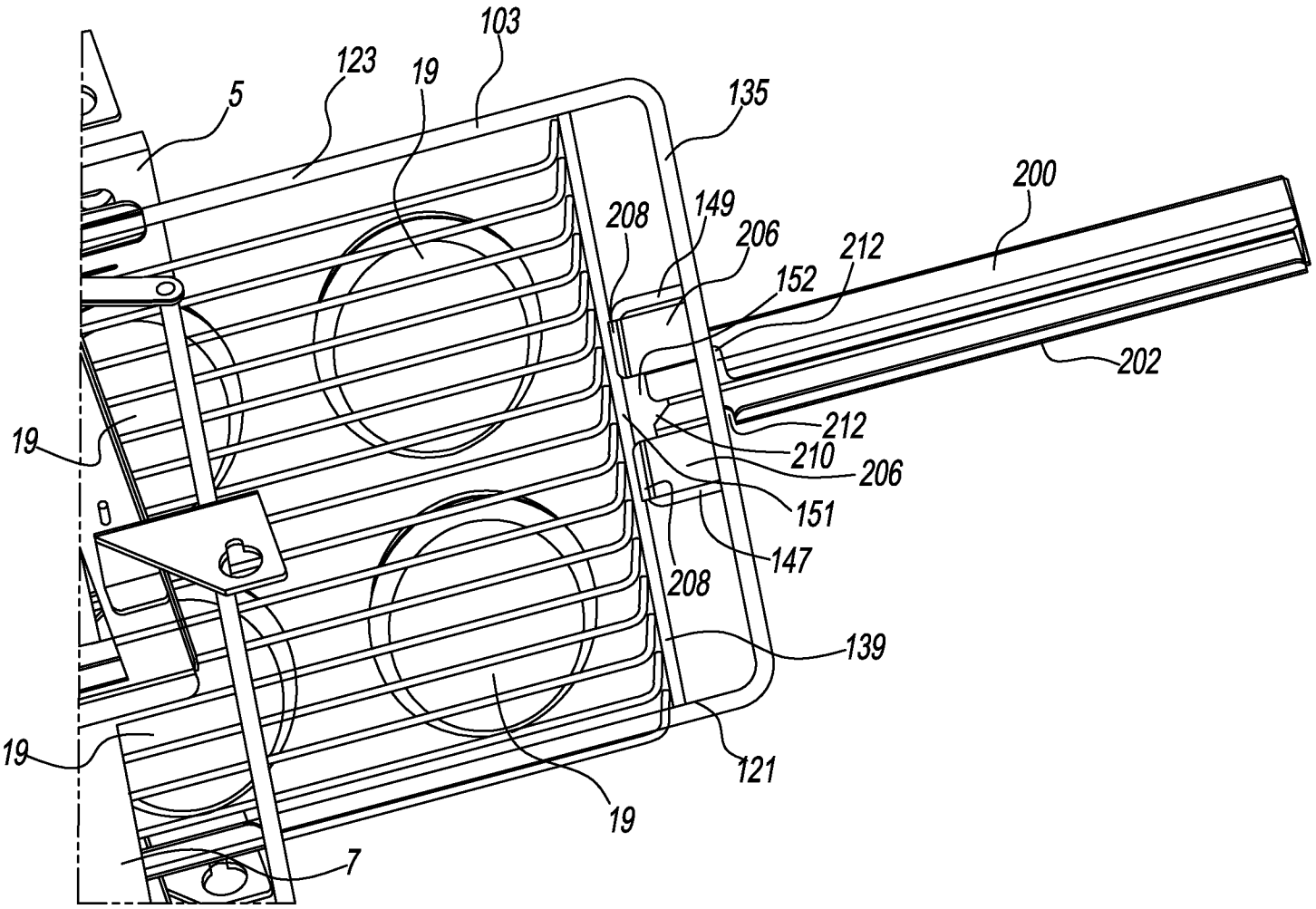
FIG. 12 is a bottom right side perspective view of the two sided grilling apparatus of FIG. 5A in the open position with the food rack connected to the rack tool and being removed therefrom.

Referring to FIGS. 11 and 12, rack tool 200 connects to food rack 103 by positioning two side flanges 206 through space 152 and under middle member 151 to position hook members 208 behind front intermediate wire 139 so that connection grooves 210 each fit around front intermediate wire 139 and connection apertures 212 fit around front wire 135. To disconnect rack tool 200 from food rack 103, handle portion 202 of rack tool 200 is moved in a direction, as shown by arrow F, so that hook members 208 are moved below front intermediate wire 139 and flanges 206 can be moved upwards through space 152.

Figure 13:
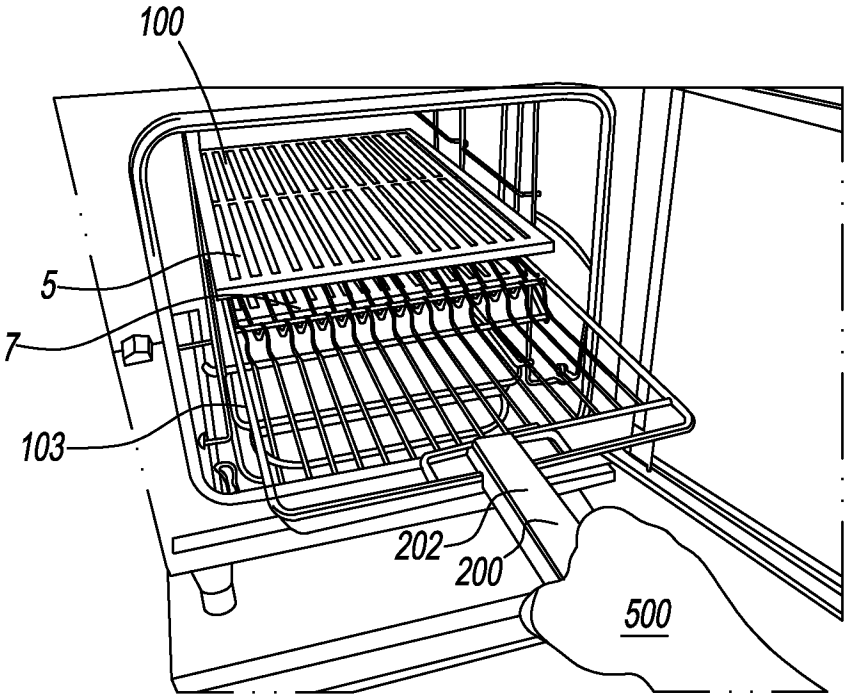
FIG. 13 is a front left side perspective view of the two sided grilling apparatus of FIG. 5A in the open position with the food rack being inserted therein, wherein the two sided grilling apparatus is in an oven and the food rack is connected to the rack tool in an engaged position.

Referring to FIG. 13, rack tool 200 is connected to food rack 103 by positioning two side flanges 206 through space 152 and under middle member 151 to position hook members 208 behind front intermediate wire 139 so that connection grooves 210 each fit around front intermediate wire 139 and connection apertures 212 fit around front wire 135. Rack tool 200 is connected to food rack 103 that is on sliding rails 17 so that the hand 500 of the user may grasp handle portion 202 of rack tool 200 and push food rack between upper grid 5 and lower grid 7 of two sided grilling apparatus 100.

Figure 14:
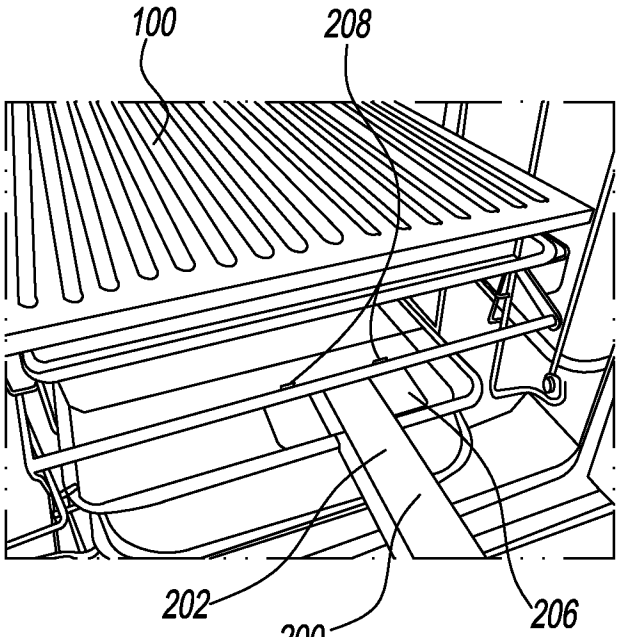
FIG. 14 is a front left side perspective view of the two sided grilling apparatus of FIG. 5A in the open position with the food rack being inserted therein, wherein the two sided grilling apparatus is in the oven and a handle of the two sided grilling apparatus is connected to the rack tool in an engaged position.

Referring to FIG. 14, rack tool 200 is disconnected from food rack 103. Rack tool 200 is positioned to place two side flanges 206 below handle 11 and hook members 208 behind handle 11 so that the user may grasp handle portion 202 and rotate handle 11 to move two sided grilling apparatus 100 from the open positioned to the closed position.

Figure 15:
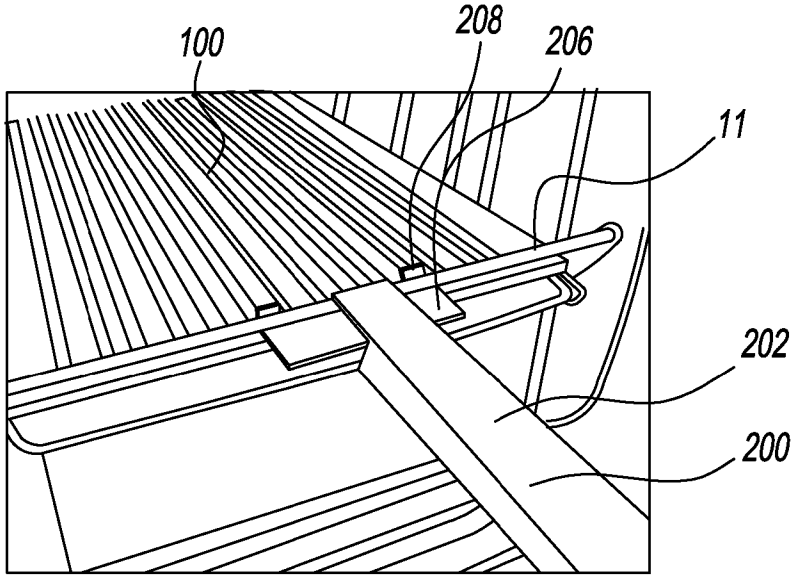
FIG. 15 is a front left side perspective view of the two sided grilling apparatus of FIG. 5A in the oven and in the closed position with the food rack being therein, wherein the handle is connected to the rack tool in a closing configuration.

Referring to FIG. 15, rack tool 200 has rotated handle 11 to move two sided grilling apparatus 100 to the closed position so that the oven may be closed and the food items may be cooked.

Figure 16:
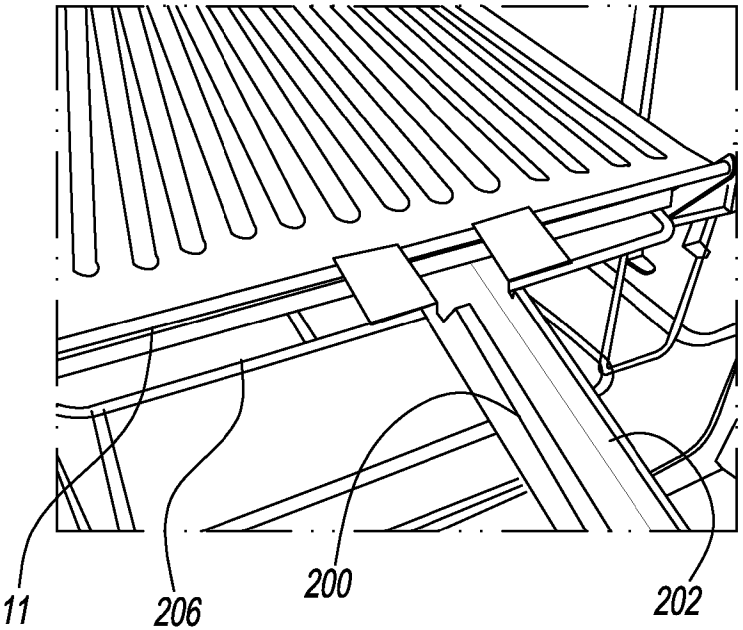
FIG. 16 is a front left side perspective view of the two sided grilling apparatus of FIG. 5A in the oven and in the closed position with the food rack therein, wherein the handle is connected to the rack tool in an opening configuration.

Referring to FIG. 16, rack tool 200 is rotated 180 degrees or turned upside-down allowing side flanges 206 to be positioned above handle 11 and hook members 208 extend behind handle 11 so that the user may grasp handle portion 202 and rotate handle 11 to move two sided grilling apparatus 100 from the closed positioned to the open position.

Figure 17:
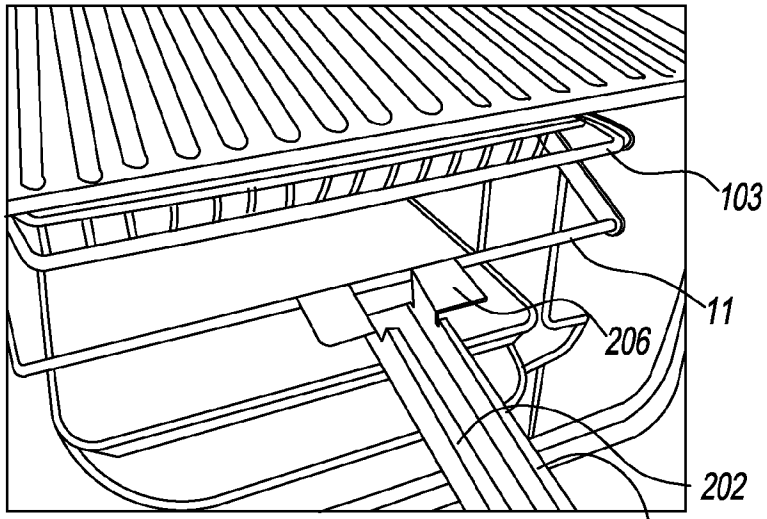
FIG. 17 is a front left side perspective view of the two sided grilling apparatus of FIG. 5A in the oven and in the open position with the food rack therein, wherein the handle is connected to the rack tool in the opening configuration.

Referring to FIG. 17, rack tool 200 has rotated handle 11 to move two sided grilling apparatus 100 to the open position.

Figure 18:
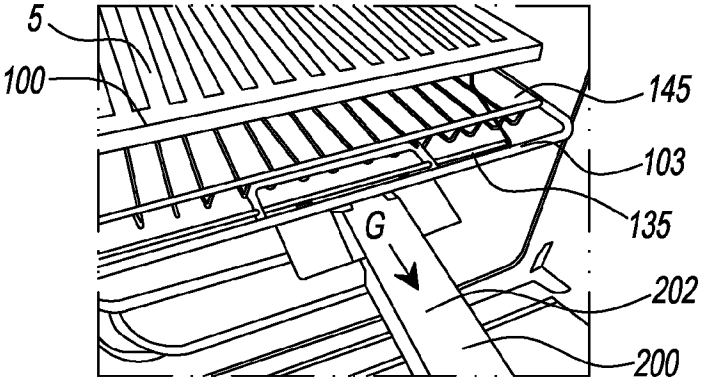
FIG. 18 is a front left side perspective view of the two sided grilling apparatus of FIG. 5A in the open position with the food rack being removed therefrom, wherein the two sided grilling apparatus is in the oven and the food rack is connected to the rack tool in a hooked position.

Referring to FIG. 18, rack tool 200 is again rotated 180 degrees or turned upside-down, relative to FIG. 16, allowing side flanges 206 to be positioned below front wire 135 and hook members 208 behind front wire 135 so that the user may grasp handle portion 202 to move food rack 103 on sliding rails 17, as shown by arrow G, moving connector wire 145 outside of upper grid 5 and lower grid 7 of two sided grilling apparatus 100.

Figure 19:
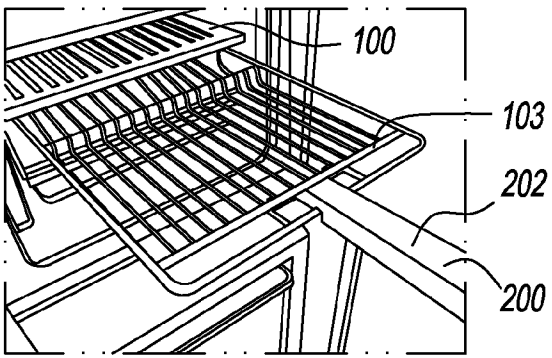
FIG. 19 is a front left side perspective view of the two sided grilling apparatus of FIG. 5A in the open position with the food rack being removed therefrom, wherein the two sided grilling apparatus is in the oven and the food rack is connected to the rack tool in the engaged position.

Referring to FIG. 19, once the user moves food rack 103 on sliding rails 17 moving connector wire 145 outside of upper grid 5 and lower grid 7, rack tool 200 is connected to food rack 103 by positioning two side flanges 206 through space 152 and under middle member 151 to position hook members 208 behind front intermediate wire 139 so that connection grooves 210 each fit around front intermediate wire 139 and connection apertures 212 fit around front wire 135 so that food rack 103 can be removed from two sided grilling apparatus 100.

Figure 21:
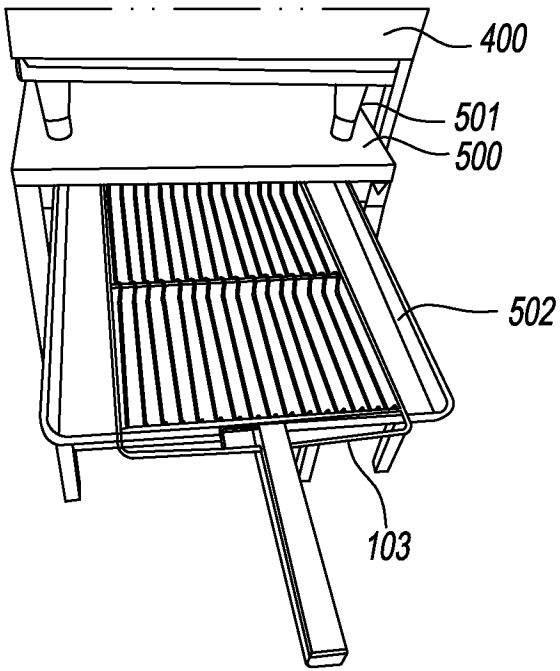
FIG. 21 is a front left side perspective view of the oven support of FIG. 20 having a food rack on the oven support.
Figure 20:
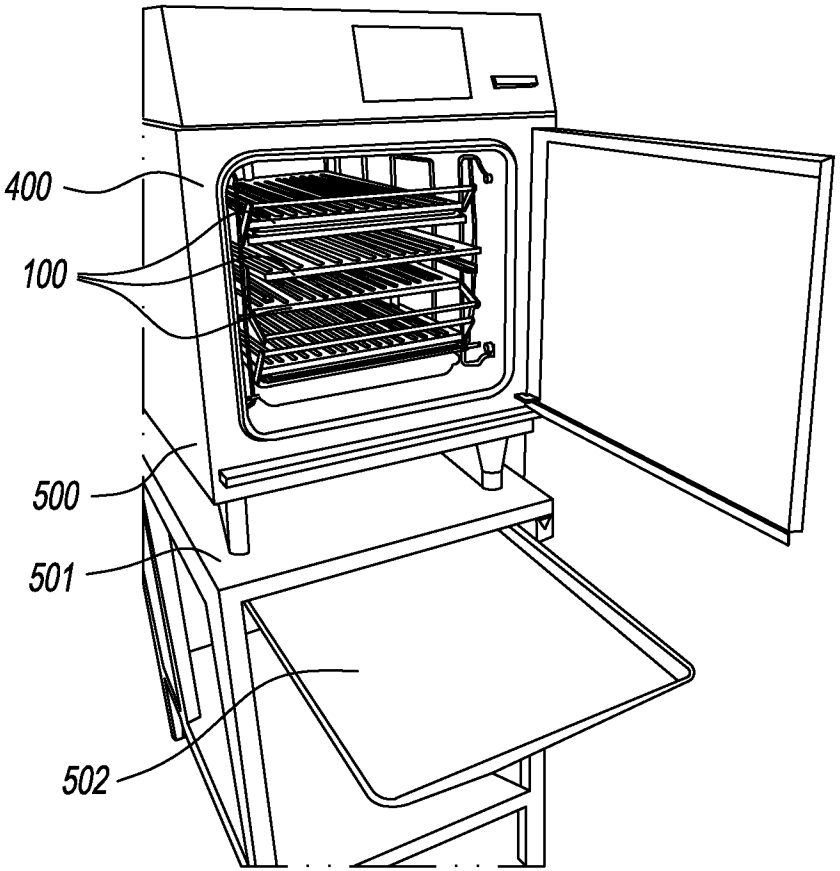
FIG. 20 is a front left side perspective view of a plurality of two sided grilling apparatuses of FIG. 5A in the oven, wherein the oven is on an oven support.

Referring to FIGS. 20 and 21, a plurality of two sided grilling apparatuses 100 are in an oven 400 that is on an oven support 500. Oven support 500 has a support surface 501 and a drawer 502. Drawer 502 may be retracted into oven support 500 below support surface 501. Support surface 501 supports oven 400. Drawer 502 is sized to support food rack 103. Rack 103 may be placed on drawer 502 prior to insertion into oven 400 for food preparation. Rack 103 also may be placed on drawer 502 after removal from oven 400 while still heated from oven 400.

Figure 22:
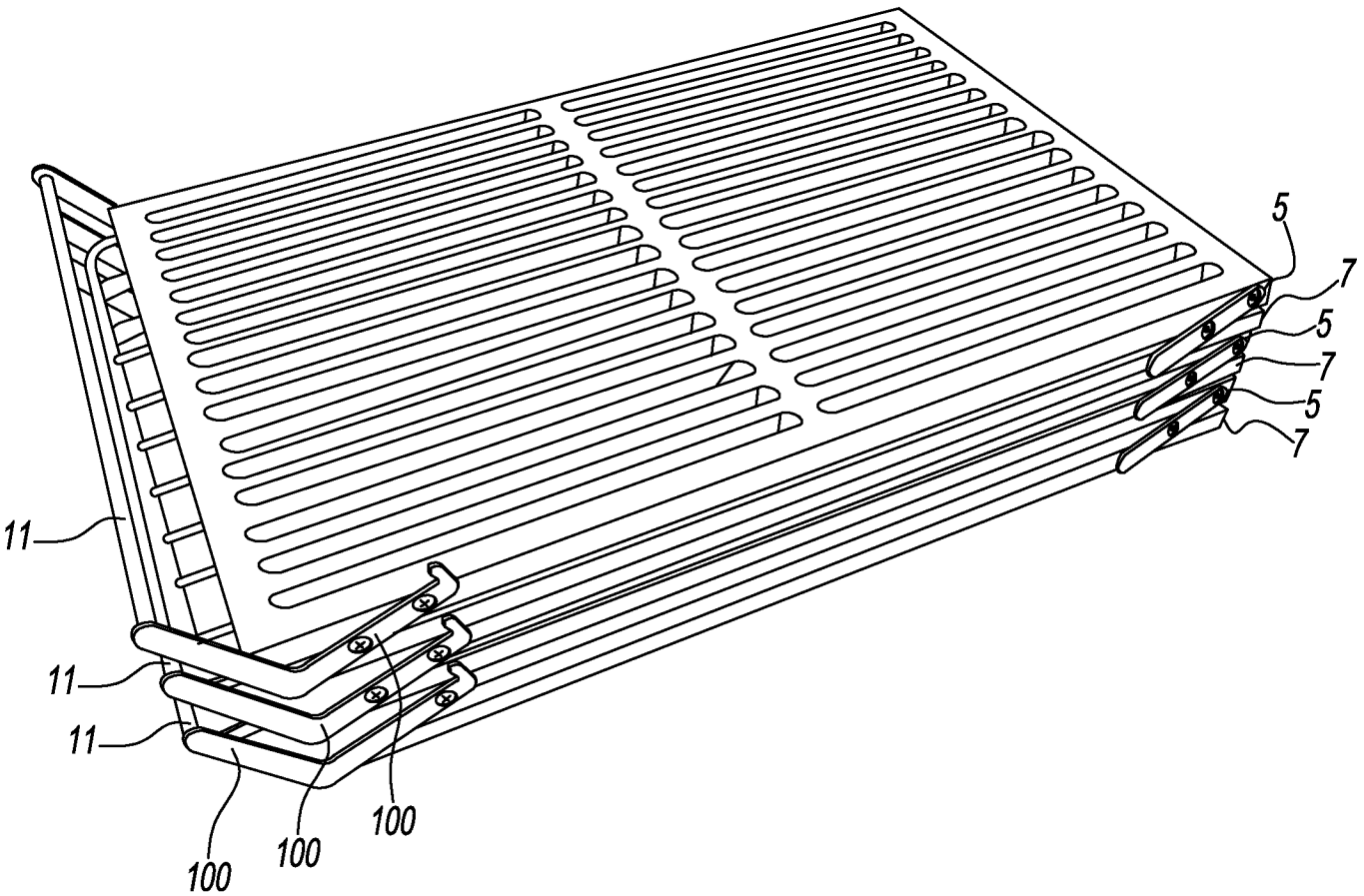
FIG. 22 is a front right side perspective view of a plurality of two sided grilling apparatuses of FIG. 5A in a nested configuration.

Referring FIG. 22, two sided grilling apparatuses 100 in the closed position may be stacked in a "nested" configuration. The shape of handles 11 maintain the alignment between two sided grilling apparatuses 100 in the nested configuration as well as allows upper grid 5 of a first two sided grilling apparatus 100 contact lower grid 7 of a second two sided grilling apparatus 100 that is above the first two sided grilling apparatus 100 to minimize a size of the nested configuration.

Figure 36:
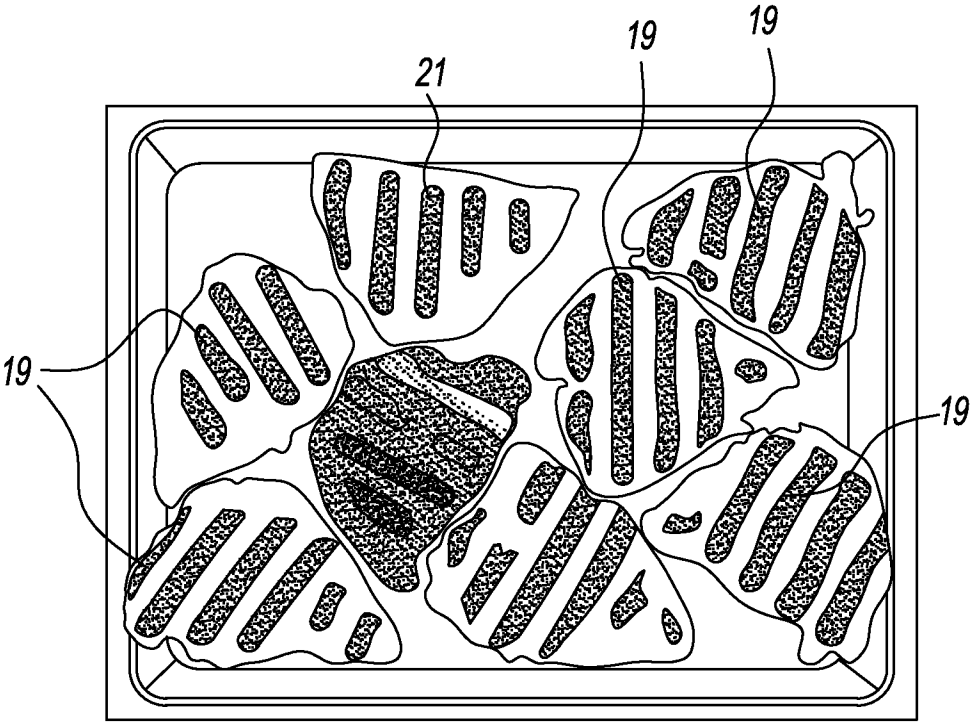
FIG. 36 is a top view of chicken breasts that have been cooked in the two sided grilling apparatus of FIG. 5A.

Referring to FIG. 36, two sided grilling apparatus 100 contacts food items 19 with both upper grid 5 and lower grid 7 simultaneously to form grill marks 21 on both sides of food items 19 during cooking. Therefore, food items do not need to be placed on a grated surface in an oven to cook a first side and then manually flip the food product over to cook the second side.

Figure 23:
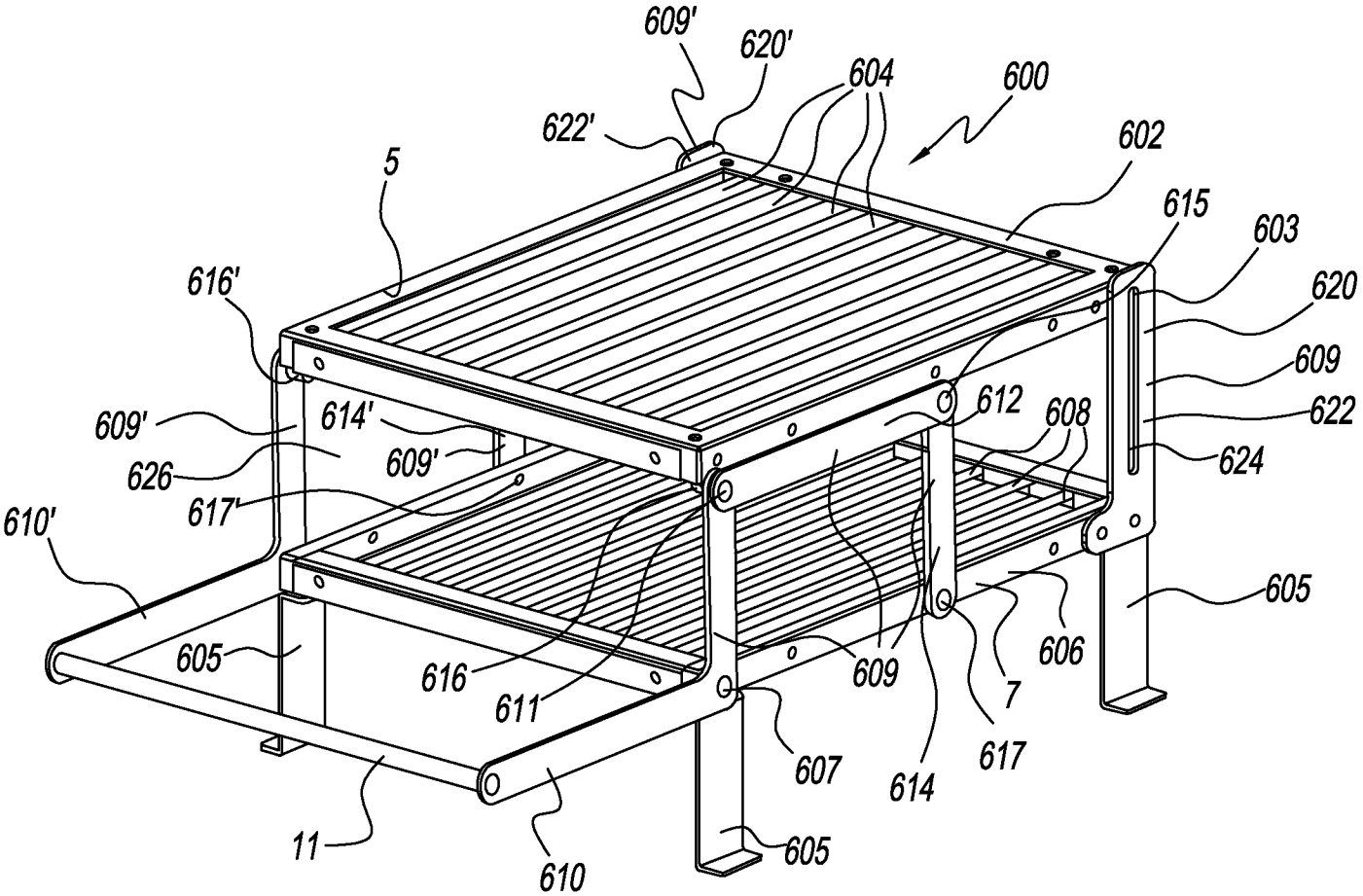
FIG. 23 is a front right side perspective view of another embodiment of a two sided grilling apparatus according to the present disclosure in the open position.

FIG. 23 is a front left side perspective view of another embodiment of the two sided grilling apparatus according to the present disclosure generally referred to by reference numeral 600 in the open position. Two sided grilling apparatus 600 is similar to two sided grilling apparatus 1, however, connectors 609, 609' are different than connectors 9,9' and two sided grilling apparatus 600 does not include sliding rails 17. Features that are the same in two sided grilling apparatus 600 and two sided grilling apparatus 1 will be identified by the same reference numerals.

Figure 37:
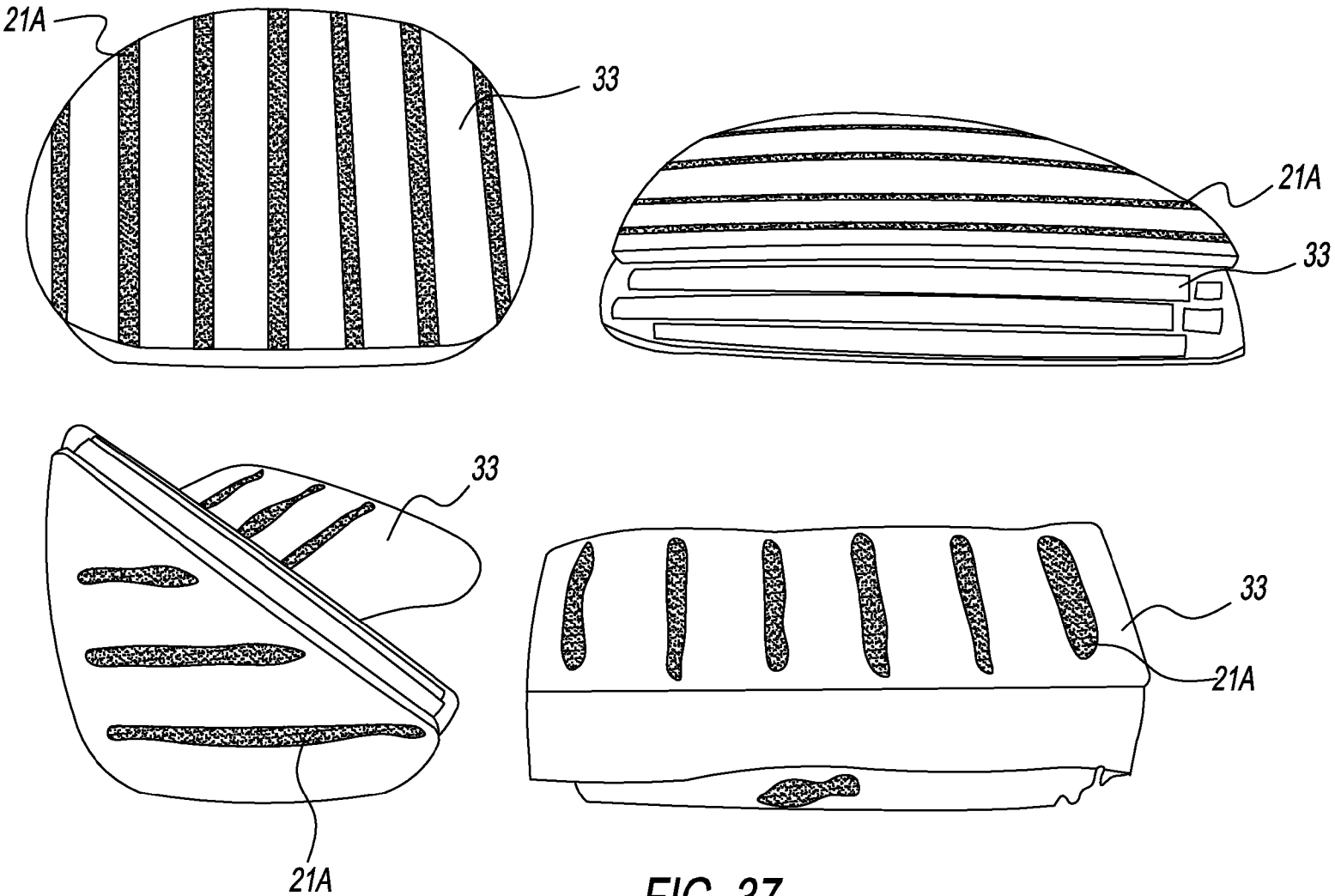
FIG. 37 is a top view of panini sandwiches that have been cooked in the two sided grilling apparatus of FIG. 23.

Upper grid 5 has an upper frame 602 that connects upper grids 604. Lower grid 7 has a lower frame 606 that connects lower grids 608. Lower frame 606 is supported on legs 605. Food items may be place directly on lower grid 7 without the use of food rack 3 or two sided grilling apparatus 600 may be modified to include sliding rails 17 similar to two sided grilling apparatus 1. Two sided grilling apparatus 600 may be made of metal materials. Upper grids 604 and lower grids 608 may be a material made of silicon carbide that absorb microwaves and does not cause arcing. Referring to FIG. 37, two sided grilling apparatus 600 was used in an oven that uses microwaves for heating to cook panini sandwiches 33 that contacted panini sandwiches 33 with both upper grid 5 and lower grid 7 simultaneously to form grill marks 21A on both sides of panini sandwiches 33 during cooking.

Connectors 609, 609' are mirror images of one another. Handle 11 is connected to handle member 610, 610' that is "L"-shaped. Handle member 610, 610' is connected to lower frame 606 at the corner of the "L"-shape by a connector 607, 607' so that handle member 610, 610' is rotatable around connector 607, 607'. Upper member 612, 612' is connected to handle member 610, 610' on a first end by a connector 611, 611' and rear member 614,614' on an opposite end by a connector 615, 615'. Upper member 612, 612' and handle member 610, 610' are rotatable around connector 611, 611'. Upper member 612, 612' and rear member 614,614' are rotatable around connector 615, 615'. Rear member 614,614' is connected to lower frame 606 on an end opposite upper member 612, 612' by a connector 617, 617'. Rear member 614,614' is rotatable around connector 617, 617'.

Figure 26:
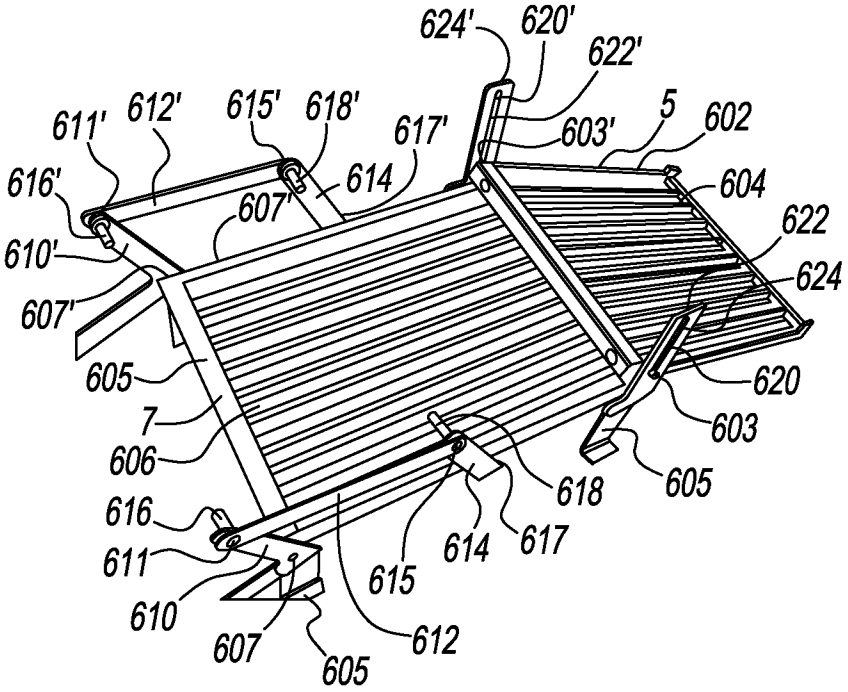
FIG. 26 is a front right side perspective view of the two sided grilling apparatus of FIG. 23 in the open position and an upper grid in an inverted position.

First support pegs 616, 616' protrude from handle member 610, 610' at the connection between handle member 610, 610' and upper member 612, 612'. As shown in FIG. 26, second support pegs 618, 618' protrudes from rear member 614,614' at the connection between rear member 614,614' and upper member 612, 612'. First support pegs 616, 616' and second support pegs 618, 618' may be screws with polytetrafluoroethylene, marketed under the trade name Teflon, coating. Alternatively, First support pegs 616, 616' and second support pegs 618, 618' may be ceramic.

Referring back to FIG. 23, connectors 609, 609' each have a rear slider 620,620'. Rear sliders 620,620' have a wall 622, 622' with elongated slots 624,624' through wall 622,622'. Upper frame 602 has pins 603, 603' that each extend in one of elongated slots 624,624' and can move in elongated slots 624,624'.

Figure 24:
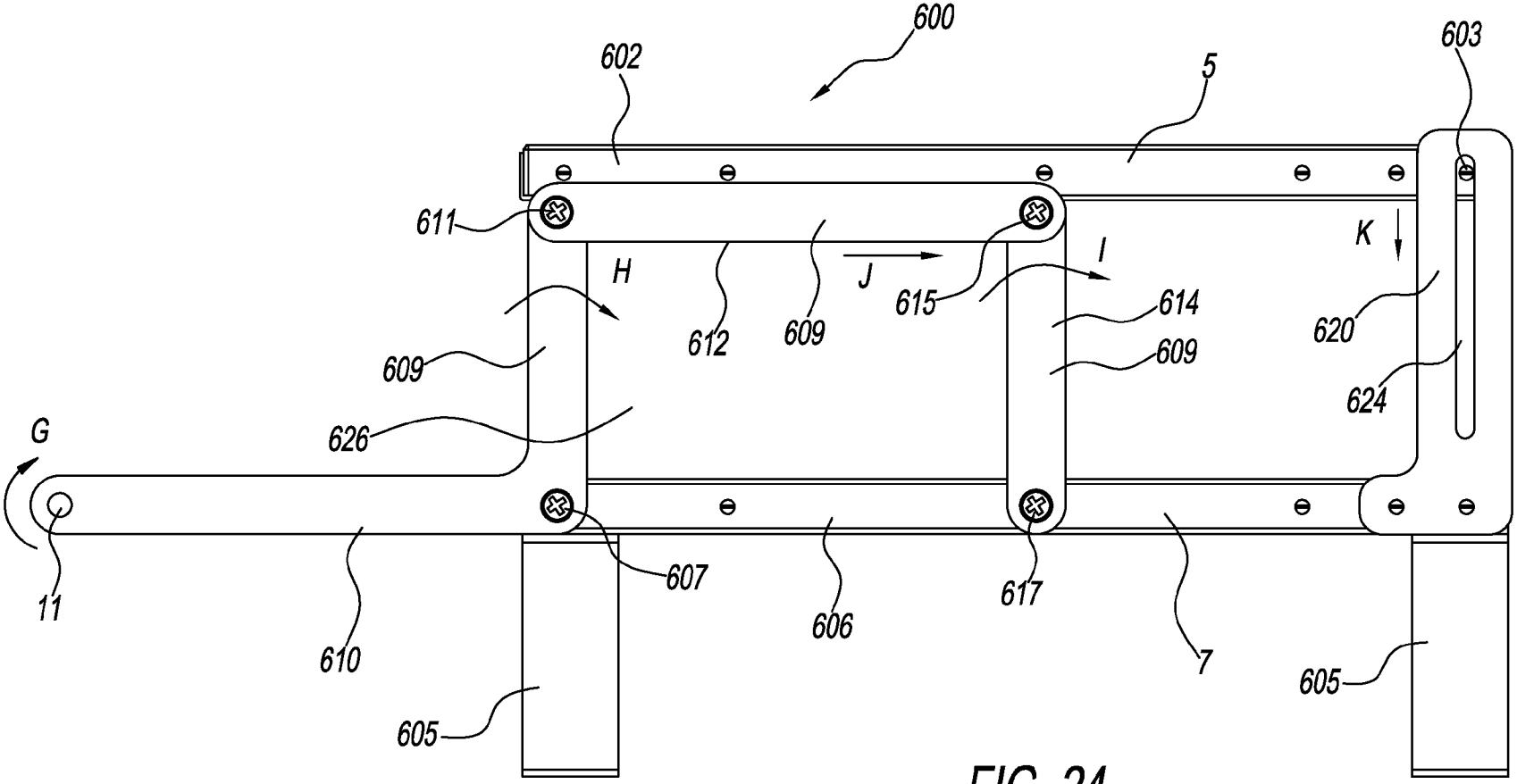
FIG. 24 is a right side view of the two sided grilling apparatus of FIG. 23 in the open position.
Figure 25:
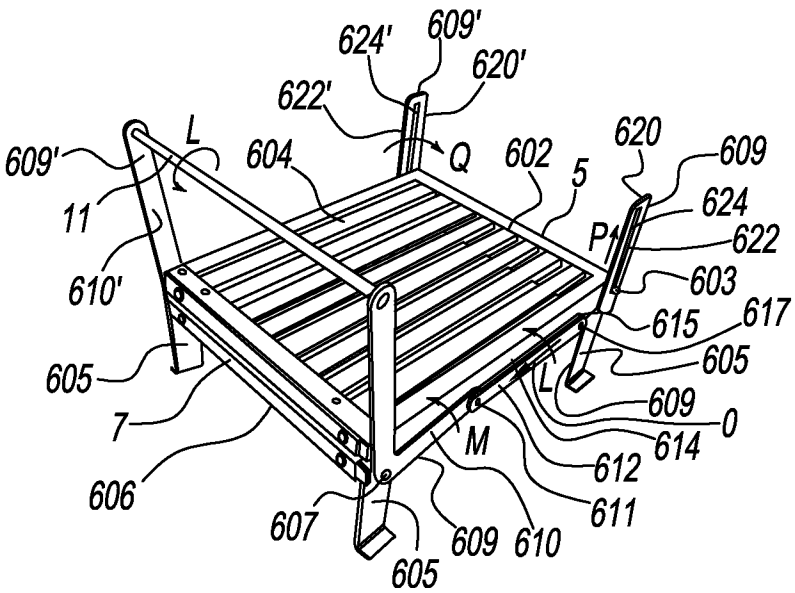
FIG. 25 is a front right side perspective view of the two sided grilling apparatus of FIG. 23 in the closed position.

Referring to FIG. 24, in the open position, upper grid 5 is supported on first support pegs 616, 616' and second support pegs 618, 618' to create a space 626 between upper grid 5 and lower grid 7. First support pegs 616, 616' and second support pegs 618, 618' are not fixed to upper grid 5. Handle 11 is rotated, as shown by arrow G, to rotate handle member 610, 610', as shown by arrow H, and rear member 614,614', as shown by arrow I, and slides first support pegs 616, 616' and second support pegs 618, 618' against upper grid 5 to move upper member 612, 612' along upper grid 5, as shown by arrow J, moving upper grid 5 toward lower grid 7 to the closed position, as shown in FIG. 25. As upper grid 5 moves toward lower grid 7, pins 603, 603' move toward lower grid 7, as shown by arrow K, in apertures 624,624'.

Referring to FIG. 25, handle 11 is rotated, as shown by arrow L, to rotate handle member 610, 610', as shown by arrow M, and rear member 614,614', as shown by arrow N, and moves upper member 612, 612' along upper grid 5, as shown by arrow O, moving upper grid 5 away from lower grid 7 to the open position, as shown in FIG. 24. As upper grid 5 moves away from lower grid 7, pins 603, 603' move away from lower grid 7, as shown by arrow P, in apertures 624,624'.

Figure 27:
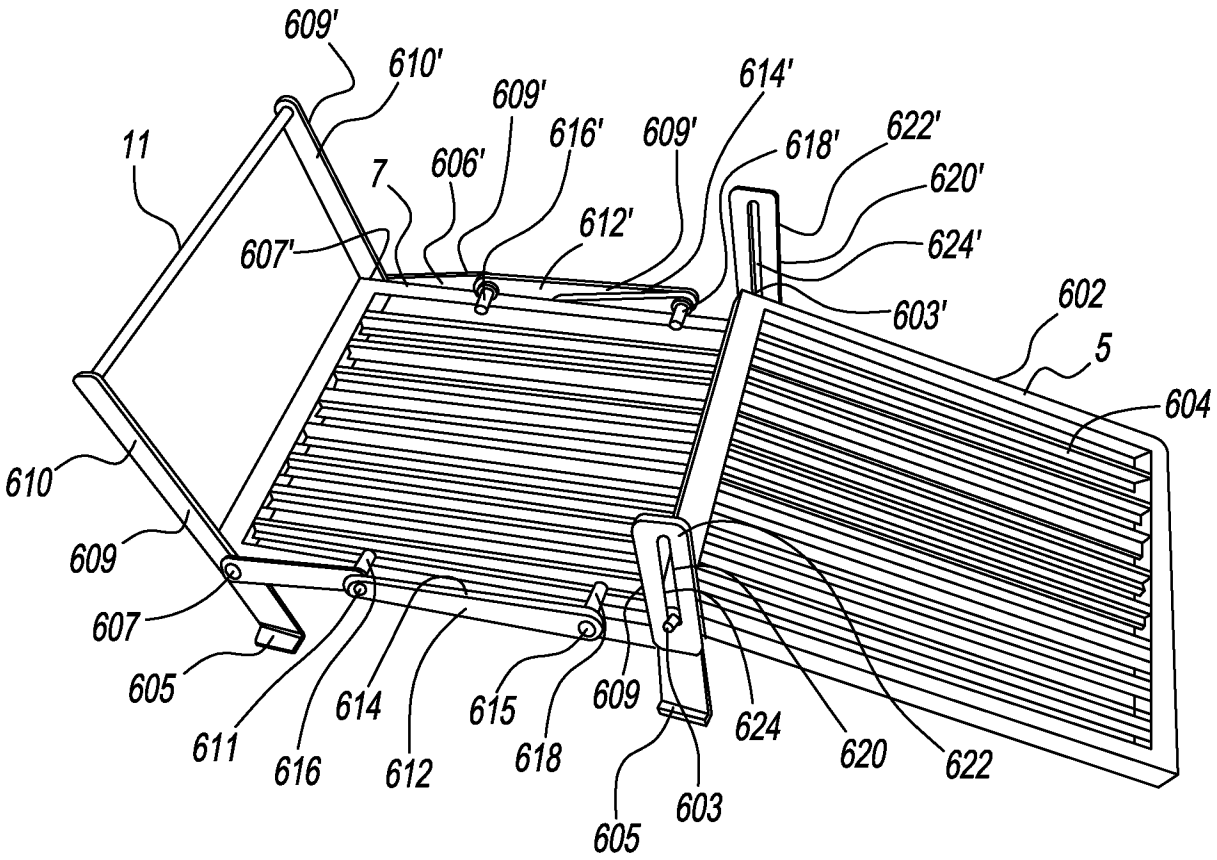
FIG. 27 is a front right side perspective view of the two sided grilling apparatus of FIG. 23 in the closed position and the upper grid in the inverted position.

Referring to FIG. 25, since first support pegs 616, 616' and second support pegs 618, 618' are not fixed to upper grid 5, upper grid 5 may rotate about pins 603, 603' in apertures 624,624' to rotate upper grid 5 away from lower grid 7, as shown by arrow Q, and inverting upper grid 5 to an inverted position, as shown in FIGS. 26 and 27. The inverted position allows for ease of cleaning of two sided grilling apparatus 600, and, in particular, ease of cleaning of upper grids 604 and lower grids 608.

Figure 27A:
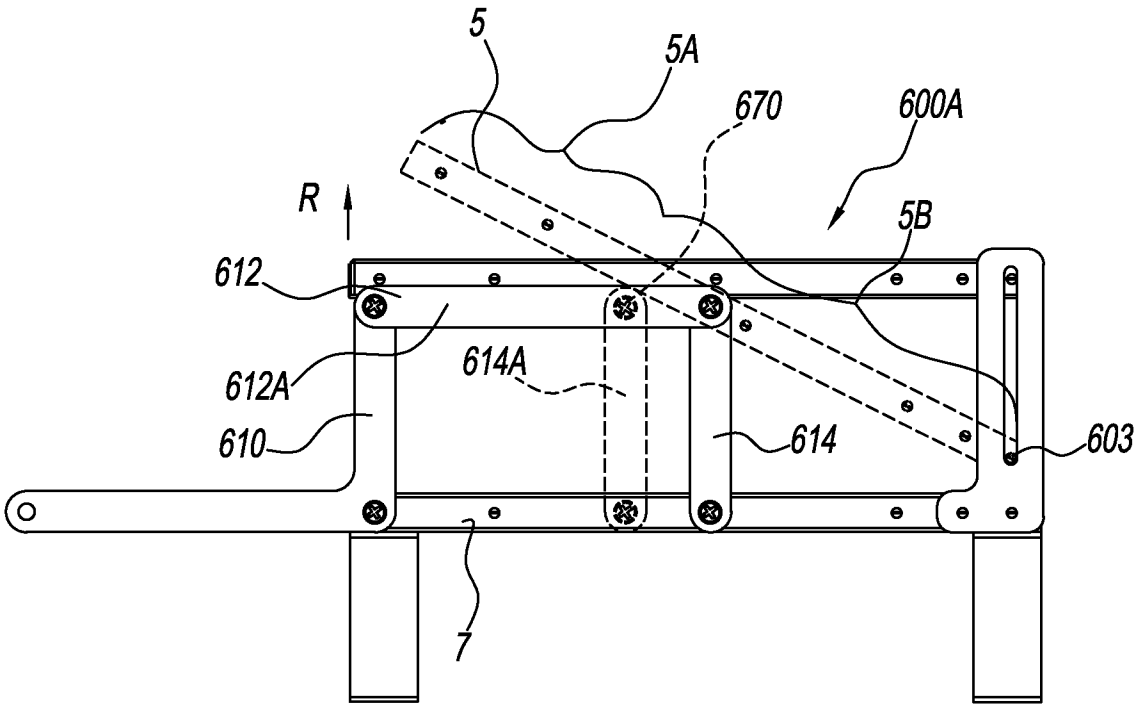
FIG. 27A is a right side view of the two sided grilling apparatus of FIG. 23 in the open position with an alternative configuration shown in broken lines.

Referring to 27A, upper member 612, 612' may be sized to position rear member 614,614' closer to handle member 610, 610', as shown in broken lines by upper member 612A and rear member 614A of two sided grilling apparatus 600A in FIG. 27A to create a pivot point 670 on upper member 612A and second support peg (not shown) connected thereto. Pivot point 670 separates a length of upper grid 5 into length 5A and length 5B. Pivot point 670 is positioned so that length 5A is less than length 5B. In the open position, upper grid 5 tilts on the peg connected to upper member 612A toward pins 103, 103' due to gravity or a force applied by a user in a direction as shown by arrow R creating a larger space adjacent handle member 610, 610' between upper grid 5 and lower grid 7 in two sided grilling apparatus 600A in the open position relative to two sided grilling apparatus 600.

Figure 28:
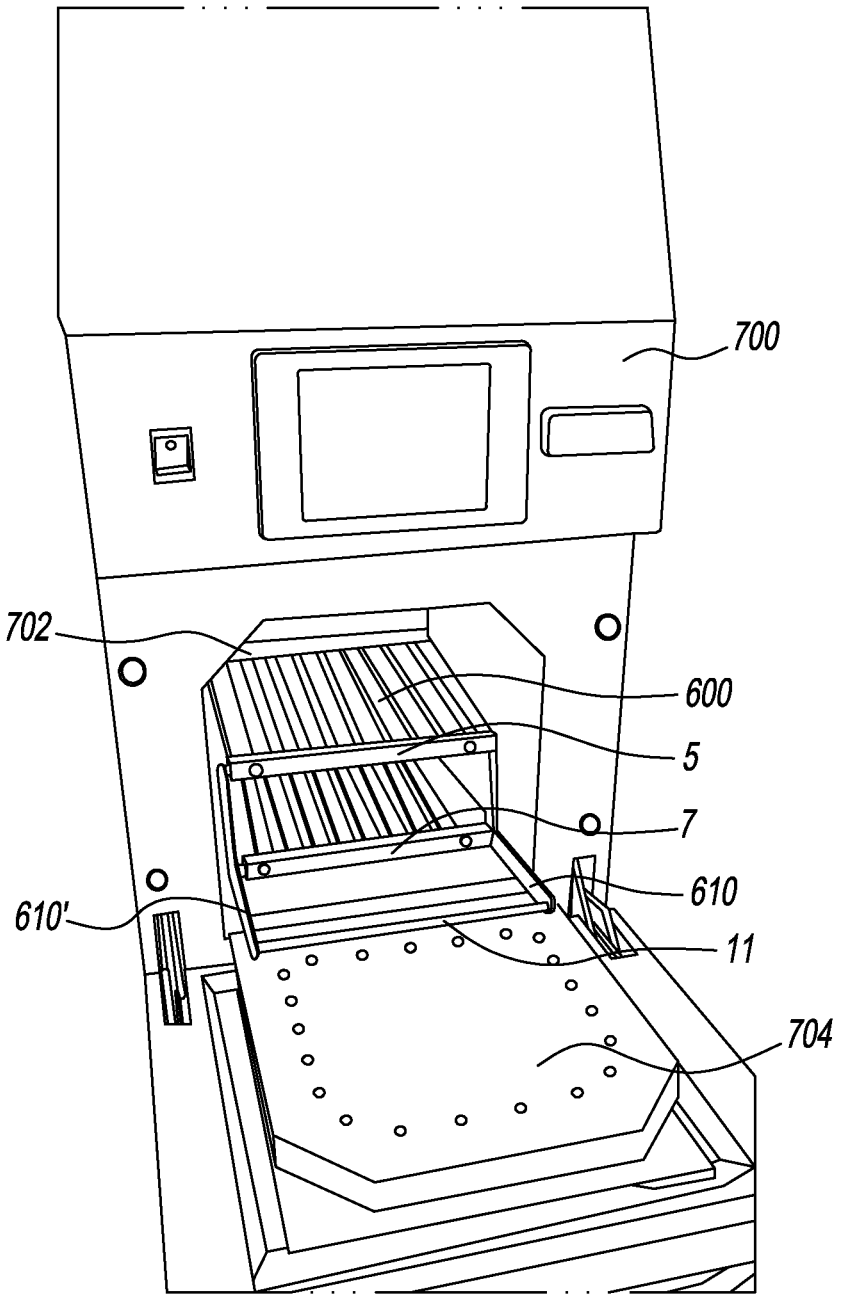
FIG. 28 is a front left side perspective view of the two sided grilling apparatus of FIG. 23 in the open position in an oven.
Figure 29:
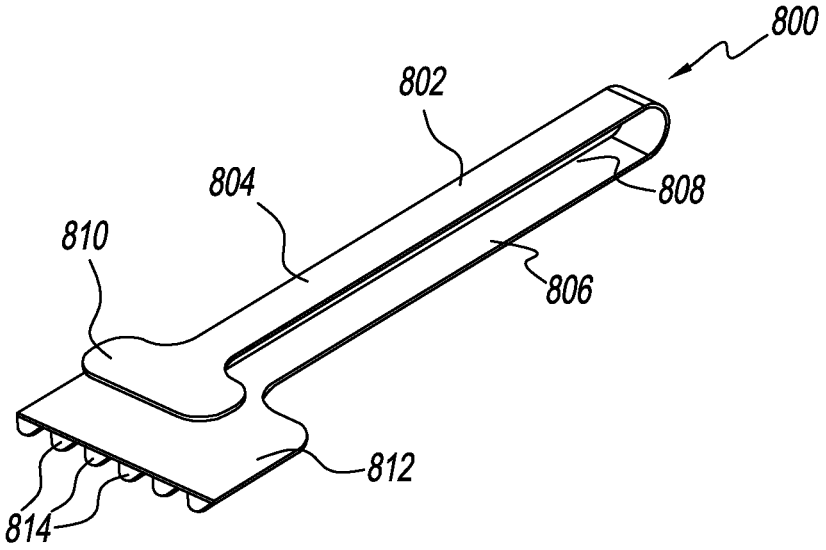
FIG. 29 is a front right side perspective view of tongs of the present disclosure.
Figure 30:
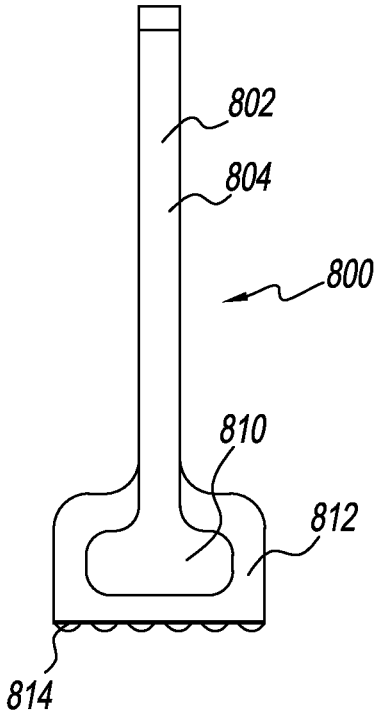
FIG. 30 is a top view of the tongs of FIG. 29.
Figure 31:
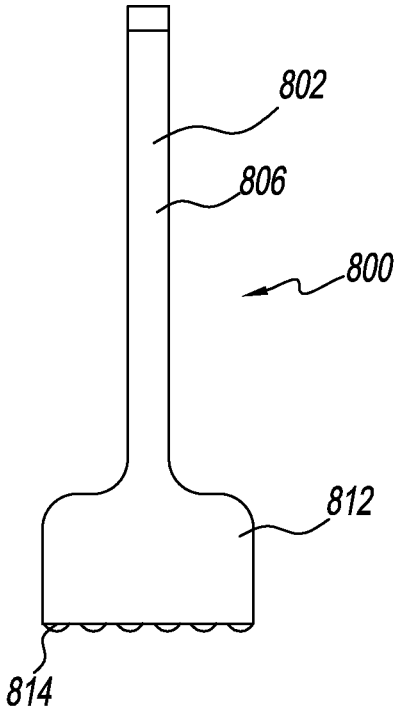
FIG. 31 is a bottom view of the tongs of FIG. 29.
Figure 32:
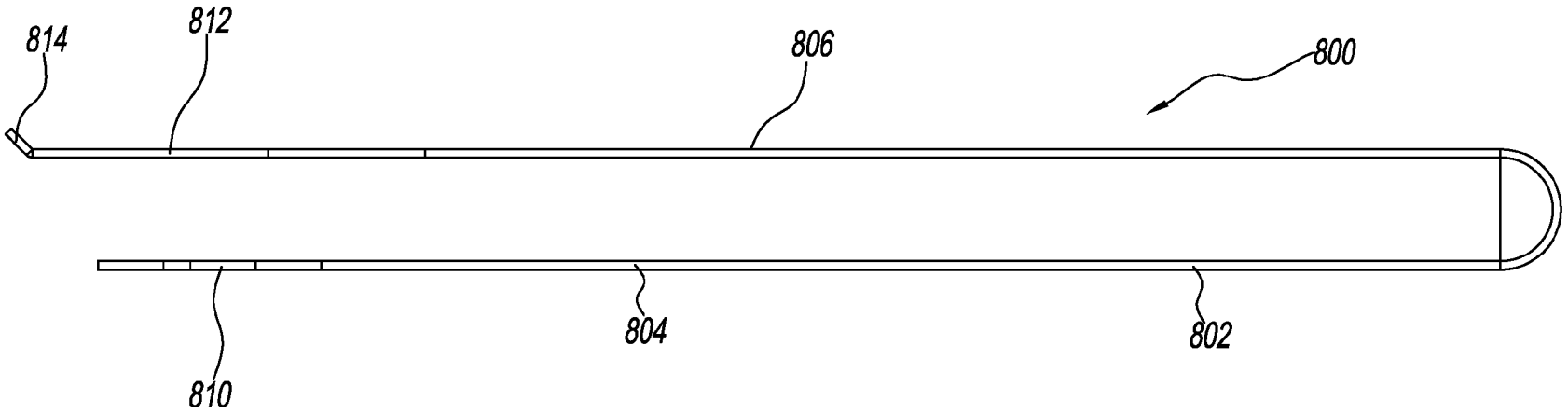
FIG. 32 is a right side view of the tongs of FIG. 29.

Referring to FIG. 28, two sided grilling apparatus 600 can be positioned in an oven cavity 702 of an oven 700. Oven 700 has a door 704 that uncovers oven cavity 702 when in an uncovered position or opened, as shown in FIG. 28, and covers oven cavity 702 while in a covered position or closed. Handle member 610, 610' may be sized so that door 704 contacts handle member 610, 610' when moving from the uncovered position to the covered position to move two sided grilling apparatus 600 from the open position to the closed position allowing oven 700 to perform a cook cycle or cooking for a period of time.

Referring to FIGS. 29-32, tongs 800 may be used with two sided grilling apparatus 600. Tongs 800 have a handle 802 that is bent to form an upper handle 804 and a lower handle 806 in a "C"-shape. The bend biases upper handle 804 and lower handle 806 to be separated by space 808. Upper handle 804 has an upper flange 810 that is flat. Lower handle 806 has a lower flange 812 that has prongs 814 extending from lower flange 812 away from upper flange 810.

Figure 33:
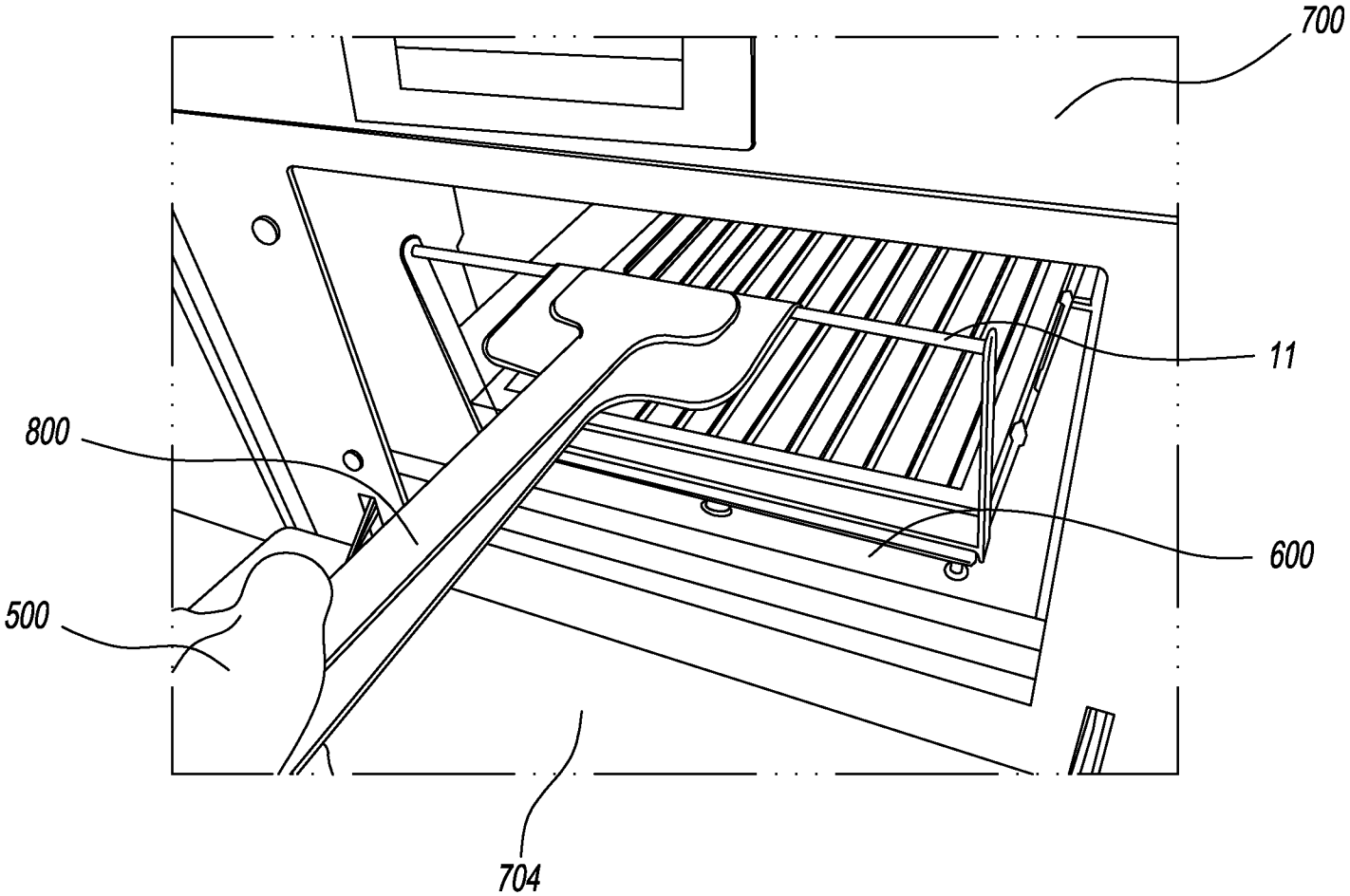
FIG. 33 is a front right side perspective view of the two sided grilling apparatus of FIG. 23 in the closed position, wherein the two sided grilling apparatus is in the oven and the tongs are connected to a handle of the two sided grilling apparatus.

Referring to FIG. 33, after completion of a cooking cycle, a user may open door 704 to the uncovered position. Hand 500 of the user may grasp tongs 800 and position prongs 814 behind handle 11 and lower flange 812 above handle 11 to move handle 11 to move two sided grilling apparatus 600 from the closed position to the open position.

Figure 34:
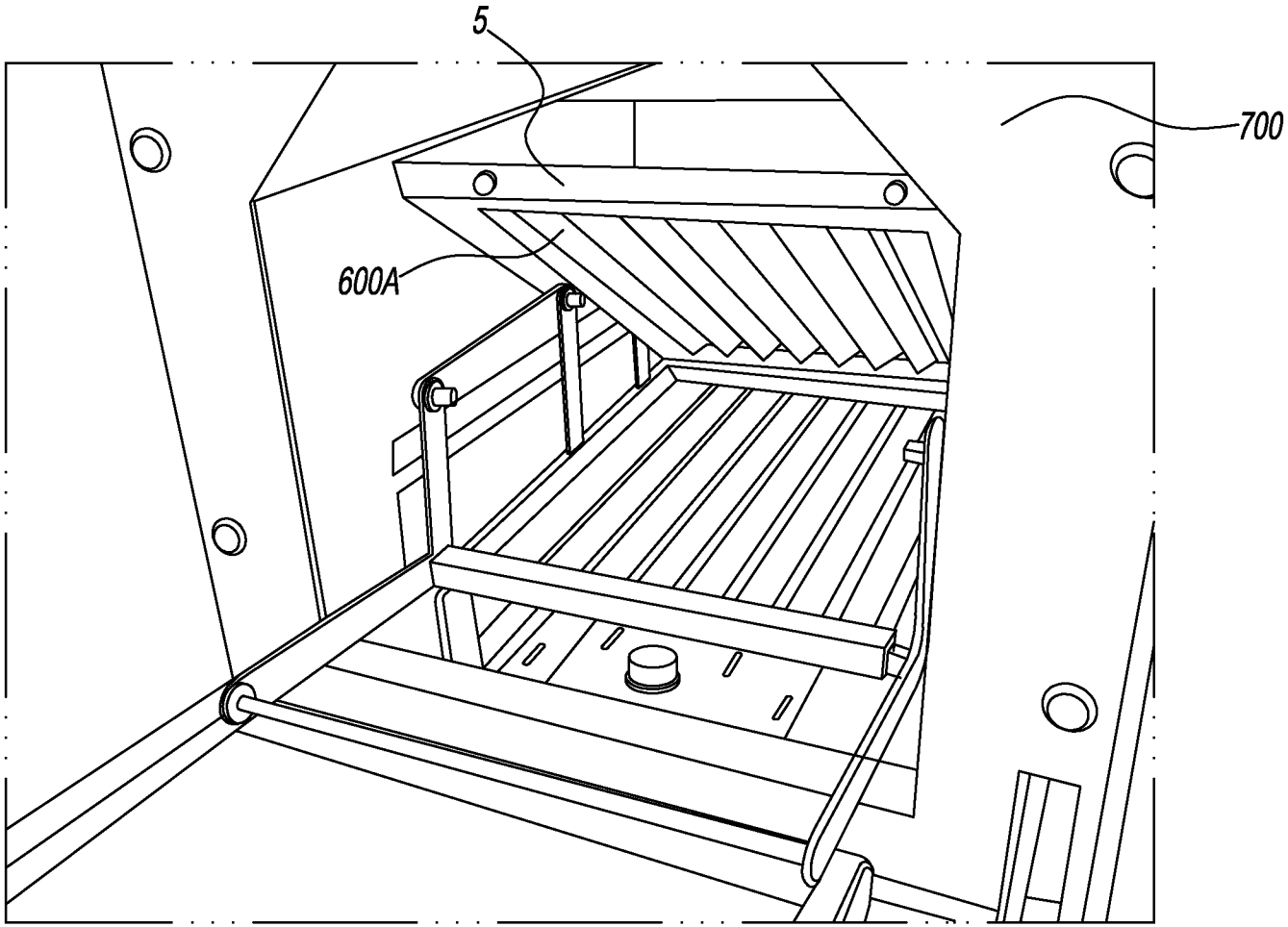
FIG. 34 is a front right side perspective view of the two sided grilling apparatus of FIG. 27A in the open position, wherein the two sided grilling apparatus is in the oven.
Figure 35:
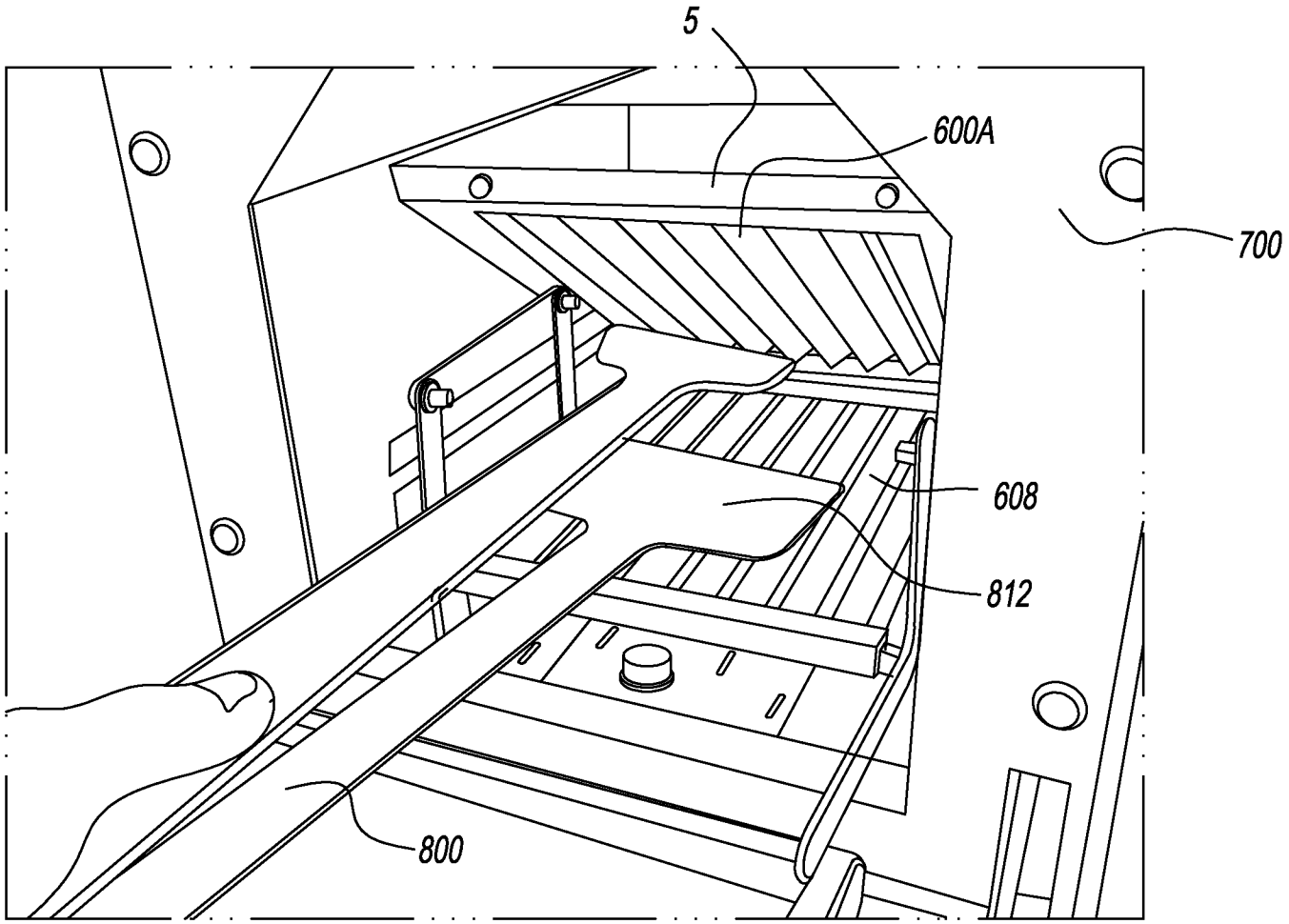
FIG. 35 is a front right side perspective view of the two sided grilling apparatus of FIG. 27A in the open position, wherein the two sided grilling apparatus is in the oven and the tongs are in the two sided grilling apparatus.

Referring to FIGS. 34 and 35, two sided grilling apparatus 600A may be used in oven 700 similar to two sided grilling apparatus 600. Tongs 800 may be used to apply the force in the direction as shown by arrow R in FIG. 27A to upper grid 5. Once in the open position, tongs 800 may be used to grasp and remove food items. Lower flange 812 may position each of prongs 814 in between adjacent lower grids 608 to assist in removal of food items, e.g., melted cheese, without breaking up or tearing the food items.

Two sided grilling apparatus, 1, 100, 600, 600A may be used with any oven. For example, two sided grilling apparatus, 1, 100, 600, 600A may be used with ovens using microwave heating, radiant heating, heating by circulating heated air (e.g., convection or impingement cooking), electric heating elements, gas heating elements, and any combinations thereof.

While I have shown and described several embodiments in accordance with my invention, it is to be clearly understood that the same may be susceptible to numerous changes apparent to one skilled in the art. Therefore, I do not wish to be limited to the details shown and described but intend to show all changes and modifications that come within the scope of the appended claims.

What is claimed is:

1. A grilling apparatus comprising:

an upper cooking grid;

a lower cooking grid;

a pair of connectors movably connecting said upper cooking grid to said lower cooking grid;

a food rack comprising a plurality of wires, wherein said food rack is removably disposed between said upper and lower cooking grids;

a pair of sliding rails affixed to said pair of connectors, thereby allowing said food rack to be slidably inserted into said grilling apparatus along said sliding rails; and a handle connected to said pair of connectors to allow said upper and lower cooking grids to move towards and away from one another, wherein said plurality of wires of said food rack are spaced apart such that when said food rack is disposed between said upper and lower cooking grids, said plurality of wires fall below said grids of said lower cooking grid, thereby allowing a food product disposed on said wire rack to be in contact with both said upper and lower cooking grids.

2. The apparatus according to claim 1, wherein said pair of connectors are movably affixed to both said upper and lower cooking grids.

3. The apparatus according to claim 1, wherein said upper and lower cooking grids each comprise a plurality of grids.

4. The apparatus according to claim 1, wherein said wires fall below said grids of said lower cooking grids when said grilling apparatus is in the closed position and move above said grids of said lower cooking grids when said grilling apparatus is in the open position.

5. The apparatus according to claim 4, wherein said food rack is connectable to a rack tool that is grasped by the user to remove or insert said food rack in said grilling apparatus, and wherein said rack tool is connectable to said handle to move said handle.

6. The apparatus according to claim 1, wherein said pair of connectors are movably affixed to said lower cooking grid and have a plurality of pegs that support said upper cooking grid so that as said pair of connectors are rotated, said plurality of pegs slide against said upper cooking grid to move said upper cooking grid towards and away from said lower cooking grid.

7. The apparatus according to claim 4, wherein said pair of connectors further comprises a connector that has wall having a slot therein, and wherein said upper cooking grid has a pin extending therefrom into said slot.

8. The apparatus according to claim 7, wherein said upper grid rotates about said pin to rotate said upper grid away from said lower grid and inverting said upper grid to an inverted position.

9. The apparatus according to claim 6, wherein at least one of said plurality of pegs is positioned so that said upper grid is tilted when said upper grid is moved away from said lower grid.

10. The apparatus according to claim 1, wherein said pair of connectors is sized so that a door of an oven contacts pair of connectors to move said upper grid toward said lower grid when said door is moving to close said oven.

11. A grilling apparatus comprising:

an upper cooking grid;

a lower cooking grid having a plurality of wires;

a pair of connectors movably connecting said upper cooking grid to said lower cooking grid;

a food rack removably disposed between said upper and lower cooking grids;

a pair of sliding rails affixed to said pair of connectors, thereby allowing said food rack to be slidably inserted into said grilling apparatus along said sliding rails;

tongs having a flange with a plurality of prongs projecting from said flange, and wherein each of said plurality of prongs fits between adjacent wires of said lower grid; and a handle which is connected to said pair of connectors to allow said upper and lower cooking grids to move towards and away from one another, wherein said tongs move said handle by contacting said handle, with said flange positioned above said handle and said plurality of prongs positioned behind said handle.

* * * * *